US008413358B2

(12) United States Patent
Betz et al.

(10) Patent No.: US 8,413,358 B2
(45) Date of Patent: Apr. 9, 2013

(54) ELECTRIC FIRE WITH MIST GENERATOR AND LIGHT SOURCE

(75) Inventors: Martin Betz, Louth (IE); Noel O'Neill, Louth (IE)

(73) Assignee: Basic Holdings, Dublin (IE)

( * ) Notice: Subject to any disclaimer, the term of this patent is extended or adjusted under 35 U.S.C. 154(b) by 0 days.

(21) Appl. No.: 12/677,918

(22) PCT Filed: Sep. 5, 2008

(86) PCT No.: PCT/EP2008/061737

§ 371 (c)(1),
(2), (4) Date: May 4, 2010

(87) PCT Pub. No.: WO2009/034020

PCT Pub. Date: Mar. 19, 2009

(65) Prior Publication Data

US 2010/0299980 A1 Dec. 2, 2010

(30) Foreign Application Priority Data

Sep. 12, 2007 (GB) ..... 0717770.2

(51) Int. Cl.
*G09F 19/00* (2006.01)

(52) U.S. Cl. ..... 40/428

(58) Field of Classification Search ..... 40/428
See application file for complete search history.

(56) References Cited

U.S. PATENT DOCUMENTS 5,989,128 A * 11/1999 Baker et al. ..... 472/65
6,050,011 A * 4/2000 Hess et al. ..... 40/428

FOREIGN PATENT DOCUMENTS

| | | |
|---|---|---|
| FR | 2 846 562 | 5/2004 |
| GB | 108097 | 7/1917 |
| GB | 1 212 399 | 11/1970 |
| GB | 2 418 014 | 3/2006 |
| GB | 2 434 441 | 7/2007 |
| GB | 2 436 212 | 9/2007 |
| WO | WO 03/063664 | 8/2003 |
| WO | WO 2006/027272 | 3/2006 |

OTHER PUBLICATIONS

International Preliminary Report on Patentability (IPRP) and Written Opinion for International Application No. PCT/EP2008/061737, Mar. 25, 2010.
International Search Report and Written Opinion for International Application No. PCT/EP2008/061737, Jun. 25, 2009.

* cited by examiner

*Primary Examiner* — Joanne Silbermann
(74) *Attorney, Agent, or Firm* — Kusner & Jaffe

(57) ABSTRACT

An electric fire is described. The fire provides one or more three dimensional flame effects to simulate the effects of a burning fire. A fuel bed for use in an electric fire is also described.

76 Claims, 17 Drawing Sheets

ELECTRIC FIRE WITH MIST GENERATOR AND LIGHT SOURCE

FIELD OF THE INVENTION

The present invention relates to electric fires and in particular to electric fires configured to simulate fire effects.

BACKGROUND

Electric fires are well known. Such fires provide a range of simulated flame and/or fuel effects. Typically these effects are generated using one or more mechanical or optical elements to create the visual impression of a burning fire. Examples of such fires include those described in our earlier application WO2006/027272.

The fire described in this earlier application and those of many of the other prior art arrangements for simulating the fuel and flames of a solid fuel fire provide a very pleasant, interesting and realistic effect, but there remains room for improvement.

SUMMARY

These and other problems are addressed in accordance with the teaching of the present invention by one or more of the following. While being described with reference to different embodiments it will be understood that elements of features of one embodiment can be used with or interchanged for elements of features of another embodiment without departing from the teaching of the invention which is to be construed as being limited only insofar as is deemed necessary in the light of the appended claims.

In a first embodiment there is provided a flame effect fire configured to generate one or more flame effects, the fire including a housing having formed therein an brick effect wall disposed behind a fuel bed. The fire may include one or more additional side walls which are arranged about the fuel bed. Such side walls may include one or more transparent elements defined therein to allow a viewer to see an interior portion of the fire and therefore appreciate the flame effects generated therein. The side walls may be fabricated entirely from a see through material such as glass or a transparent plastic such as Perspex. Desirably the flame effect is simulated from an interaction of a light source with a generated mist, the mist being carried upwardly in the fire housing on heated air currents. The side walls may include one or more air heating elements configured to blow heat downwardly over the side walls.

In a second embodiment there is provided a free standing flame effect fire having a housing and being configured to operatively generate an illuminated vapour to provide a three dimensional flame effect with said housing, the housing having a plurality of side walls, at least two of said side walls having a window through which a generated flame effect is visible such that the generated flame effect is visible through at least two sides of the housing, the fire further including a heating element configured to operatively provide heating about a perimeter of the fire.

In a third embodiment there is provided a flame effect fire comprising a housing, a flame effect generator provided within the housing and being configured to operatively generate a flame effect with said housing, a chimney projecting above and extending from the housing, an air heating element and wherein the chimney includes at least one vent through which air heated by the air heating element may exhaust the fire. Such a fire is especially useful as a standalone fire, although of course it could be configured as an inset fire for other installations. By providing a vent in the chimney—desirably located in an upper region thereof and extending at least partially about the circumference of the chimney, it is possible to distribute heat generated within fire about the housing of the fire as opposed to preferentially directing the generated heat forwardly of the fire.

A fourth embodiment provides a fuel bed element for use in the fuel bed of an electric fire, the element including a plurality of independently operable light sources.

Such a fuel bed element may be usefully employed within a fire used to simulate one or more fire effects. Such a fire may desirably include a controller for controlling operation of the independently operable light sources. The controller is desirably configured to provide a spatially varying lighting effect within the fuel element such that one or more flicker of pulsating effects may be generated within the fuel bed element. The independently operable light source may typically include one or more LEDs. In such an arrangement electric coupling between the LEDs within the fuel bed and the controller may be required. Another arrangement for the independently operable light sources may include fibre optic strands or cables which are configured to direct light from a light source to the fuel bed where they are then visible. Within the context of this embodiment both the electric coupling and the light coupling provided by the fibre optic strands may be considered as lighting connections. In both arrangements, an element remote from the fuel bed element is required to effect operation of the independently operable light sources, and a connection between this element and the fuel bed elements may be required.

To facilitate such an arrangement, such a fire may include a fire grate dimensioned to receive one or more fuel bed elements, the grate being locatable within the housing of the fire and being shaped to provide a concealed path for lighting connections to the fuel bed element.

Such a fire may additionally include an ash tray within which the grate is receivable, the ash tray including at least one lighting element to generate a lighting effect visible within the ash tray. By providing separate lighting for the ash tray and the fuel bed it is possible to create a differentiation in lighting across a vertical axis of the fuel bed. The lighting of the fuel bed elements may be configured to illuminate at a higher luminosity to that of the ash bed lighting elements such that the visual effect of a glowing ash and burning fuel bed element is effected. By enabling independent activation of different lighting elements within the fuel bed the overall visual effect of the fuel bed is improved.

Such a fire may additionally include a vapour generator provided within the housing and in such an arrangement the ash tray includes at least one aperture defined in a lower surface thereof and providing an outlet into the ash tray for vapour generated by the vapour generator.

The ash tray may include a number of fire debris elements locatable within the ash tray to at least partially occlude viewing of at least one of the lighting elements and/or aperture.

A fifth embodiment of the invention provides a flame effect fire comprising a mist or vapour generator for use in the simulation of flame effects within the fire, the mist generator including a controller for adjusting the volume of mist generated by the generator. By judiciously selecting the volume of mist generated it is possible to control the amount of vapour that is used to create flame effects. By reducing the amount of vapour, the overall impression is of less flames, whereas by increasing the volume of mist generated per a given time period it is possible to increase the perceived number of flames. Such a controller may be used to continuously adjust the volume of mist generated. The control of the volume of vapour generated may be also useful in achieving a variance in the height of a generated flame or smoke effect.

A sixth embodiment in accordance with the teaching of the invention provides a flame effect fire comprising a housing having provided therein in a mist generator, the mist generator comprising a first reservoir from which mist may be generated, the fire including a second reservoir in fluid communication which provides a liquid to the first reservoir and wherein the second reservoir is slideably removable from the fire through an opening provided in a side wall of the housing. By enabling a presentation of the removable second reservoir through the side wall of the fire, access to the fire is improved. By obviating the need to present the second reservoir vertically into the fire, it is possible to locate the second reservoir in a lower portion of the fire, adjacent to the first reservoir thereby freeing up space in the upper portion for other elements of the fire. It will also be understood that by providing side access to the housing to facilitate removal of the second reservoir that it is easier to introduce the reservoir into the housing, and it is also easier to conceal the reservoir within the housing.

A valve may be provided in the second reservoir, the valve being operable to enable a flow of liquid from the second reservoir to the first reservoir upon receipt of the second reservoir within the housing. Such a valve is also useful in obviating any leaking of fluid from the second reservoir during transport.

As the second reservoir is accessed through a side wall of the fire it is possible that it could be accidentally dislodged from the fire. To minimise such a possibility a locking element for retaining the second reservoir within the housing may be provided. Such a locking element may be disposed within the housing at a location such that insertion or removal of the second reservoir requires a two step action.

A seventh embodiment of the invention teaches a flame effect fire comprising a mist generator for generating a mist, and a mist buffer or reservoir coupled to the generator and being configured to reduce the flow rate of the mist passing from the generator prior to generation of simulated flames. Such a buffer may be formed as a separate element to the mist generator and be provided with an inlet in fluid communication with the mist generator, and at least one outlet for providing the mist to the fire. The inlet and outlet may be offset from one another. The generator and reservoir or buffer may also be integrally provided within the same container or vessel. Such a fire may also include a mist distributor for distributing the mist from the mist buffer through a plurality of apertures. The outlet of one of the mist buffer or mist generator may include at least one heated surface for generating air currents on which the generated mist may be carried. The mist generator may be provided in the form of a high pressure unit which used pressures in excess of atmospheric pressure to generate mist or vapour effects.

An eight embodiment of the invention provides a flame effect fire including a mist generator having at least two active elements operable to generate a mist, and wherein the active elements operable in a redundant fashion to achieve a lengthening in the operating lifetime of the mist generator.

A ninth embodiment of the invention provides a flame effect fire comprising a mist generator for generating a mist, a mist reservoir for gathering the mist generated by the mist generator, the mist reservoir having a vertical outlet funnel or chimney through which mist may exit upwardly from the mist reservoir, and wherein at least one surface of the funnel is heated. By heating multiple surfaces or by providing a heating of a first side more than a second side it is possible to change the characteristics of the carried mist.

The fire may include a light source offset from the outlet funnel and providing a light output directed onto the side of the exiting mist. The light source may be located adjacent to the outlet funnel such that the light is directed upwardly onto the exiting mist. In an alternative arrangement the light source is located within the fire such that it is directed downwardly onto the existing mist. By providing for the direction of light onto the side of the mist, preferential lighting of different regions of the vertical mist may be effected. By using a multicoloured light source or my using a plurality of light sources it is possible to colour grade the vertical illumination of the side of the mist such that different regions of the mist are coloured differently to other regions. By including a plurality of light elements and enabling an individual control of selected ones of that plurality it is possible to create pulsating or flicker effects within the generated flames. As the mist is carried on air currents arising from a heating of at least one surface of the outlet funnel, it is not necessary for the light source to provide the heating of the air current that carries the mist. In such an arrangement it is possible to use low voltage or low wattage lighting elements such as LEDs or the like.

Where the light sources are locatable beside the outlet funnel it is desirable to visually occlude the specifics of the light sources from a viewer to the front of the fire. Such an arrangement may be provided by including an at least partially translucent moulding disposed over the light sources.

The outlet funnel may be coupled to a planar surface providing a support for a fuel bed. In such an arrangement the planar surface will desirably be orientated substantially perpendicularly to the main axis of the outlet funnel such that exiting vapour will pass upwardly through the fuel bed supported on the planar surface.

In a tenth embodiment there is provided a flame effect fire comprising a mist generator for generating a mist, a mist reservoir for gathering the mist generated by the mist generator, the mist reservoir having a vertical outlet funnel through which mist may exit upwardly from the mist reservoir, and a light source offset from the outlet funnel and providing a light output directed onto the side of the exiting mist.

Desirably at least one surface of the funnel is heated. As described above with reference to the ninth embodiment by providing for a heating of multiple sides or preferential heating of one side more than an other may be useful in changing the effect of the generated uplifted vapour.

Similarly the light source may include a plurality of light elements which may include ones which are individually controllable and/or individually coloured. Examples of useful light elements include those provided as LEDs.

An eleventh embodiment provides a flame effect fire comprising a housing having provided therein in a mist generator, the mist generator comprising a first reservoir from which mist may be generated, the fire including a second reservoir in fluid communication which provides a liquid to the first reservoir and wherein the fire includes a filter for filtering the liquid. Such a filter usefully provides for a control in calcification or other effects which may degrade the performance of the mist generator. The filter may also or alternatively be employed to control biological growth within the reservoirs. The filter may be disposed between the first and second reservoirs. Alternatively or in addition the filter may be located in the first reservoir. Examples of useful filters include those mineral removing filters and/or anti-microbial filters Accordingly the invention provides an electric fire according to claim 1 with advantageous embodiments provided in the claims dependent thereto. The invention also provides a fuel bed element according to claim 81 with advantageous embodiments thereof provided in the claims dependent thereto.

These and other features of the invention will be better understood with reference to Figures which follow.

BRIEF DESCRIPTION OF THE DRAWINGS

The present invention will now be described with reference to the accompanying drawings in which:

FIG. 8 is a view of an integrally formed mist generator and mist reservoir provided in accordance with the teaching of the invention.

DETAILED DESCRIPTION OF THE DRAWINGS

Various aspects of the illustrative embodiments will be described using terms commonly employed by those skilled in the art to convey the substance of their work to others skilled in the art. However, it will be apparent to those skilled in the art that alternate embodiments may be practiced with only some of the described aspects. For purposes of explanation, specific numbers, materials, and configurations are set forth in order to provide a thorough understanding of the illustrative embodiments. However, it will be apparent to one skilled in the art that alternate embodiments may be practiced without the specific details. In other instances, well-known features are omitted or simplified in order not to obscure the illustrative embodiments. Furthermore features or integers described with reference to one embodiment may be interchanged with or replaced by those of another embodiment without departing from the teaching of the invention. Where embodiments or elements within Figures are described with reference to other embodiments or elements within other Figures it will be understood that those embodiments or elements may be usefully employed within the arrangements described in the other embodiments or Figures. It is not intended to imply that such embodiments or Figures require the operation of the other embodiments of Figures to function in that it is intended that certain embodiments or Figures may be operable independently of other embodiments or Figures. The phrase "in one embodiment" is used repeatedly. The phrase generally does not refer to the same embodiment; however, it may. The terms "comprising," "having," and "including" are synonymous, unless the context dictates otherwise.

Figure 1:
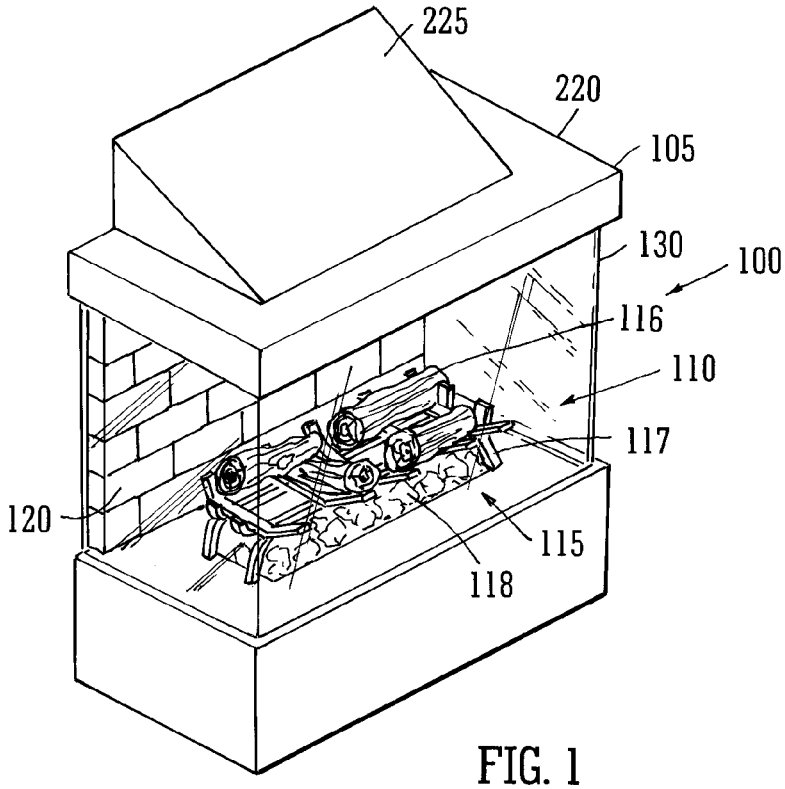
FIG. 1 is a perspective view of a fire provided in accordance with the teaching of the invention.

FIG. 1 shows an example of a flame effect fire 100 in accordance with the teaching of the invention. Such a fire includes a housing 105 defining an interior volume 110 within which one or more of flame and/or fuel effects may be generated. In the example of FIG. 1, the interior volume includes a fuel bed 115. This exemplary fuel bed 115 includes a number of fuel bed elements 116—in this example shaped to resemble logs—which are arranged on a grate 117 and located over an ash bed 118. The fire of FIG. 1 includes a brick effect wall 120 disposed behind a fuel bed. The fire is desirably utilises a vapour generator in conjunction with one or more light source to generate three dimensional flame effects which appear to originate from the fuel bed 115. Examples of the type of arrangement that may be used to generate such flame effects include those that will be described hereafter or indeed International Application PCT/EP2007/002207.

By generating one or more flame effects through the interaction of generated mist with a lighting effect, the perception to the viewer is of a three dimensional flame that is originating from the fuel bed. The pattern and orientation of the generated flame is highly dependent on the path of the air currents on which the mist is carried. As the effect is a similar in appearance to a real flame, it will be understood that the brightness of the room within which the fire is located can affect the overall perception of the fire. To assist in the visual simulation of the flame effect, the fire of FIG. 1 includes a brick wall effect 120 disposed behind the fuel bed 115. By providing such an effect, the contrast between the generated flames and the rear surface is improved, and the overall impression of the fire is improved. As the flames are generated above the fuel bed, such a fire differs from other prior art simulated fires which required the use of ribbons or the like provided behind a vertical screen to provide a flame effect. The fire of FIG. 1 does not therefore require the depth behind the fuel bed to accommodate the flame generating means of the prior art, with the result being that the fire can be fabricated as a freestanding fire.

In such an arrangement, the fire may include one or more additional side walls 130 which are arranged about the fuel bed 115. Such side walls may include one or more transparent elements defined therein to allow a viewer to see an interior portion of the fire and therefore appreciate the flame effects generated therein. As shown in FIG. 1 three such side walls are provided and are fabricated entirely from a see through material such as glass or a transparent plastic such as Perspex. As was stated above, desirably the flame effect is simulated from an interaction of a light source with a generated mist, the mist being carried upwardly in the fire housing on heated air currents. By enclosing the interior volume within the confines of the side walls, it is possible to reduce any outside air currents interfering with the heated air currents within the fire—the success of the generated flame effect is therefore not dependent on the installation location.

Figure 2:
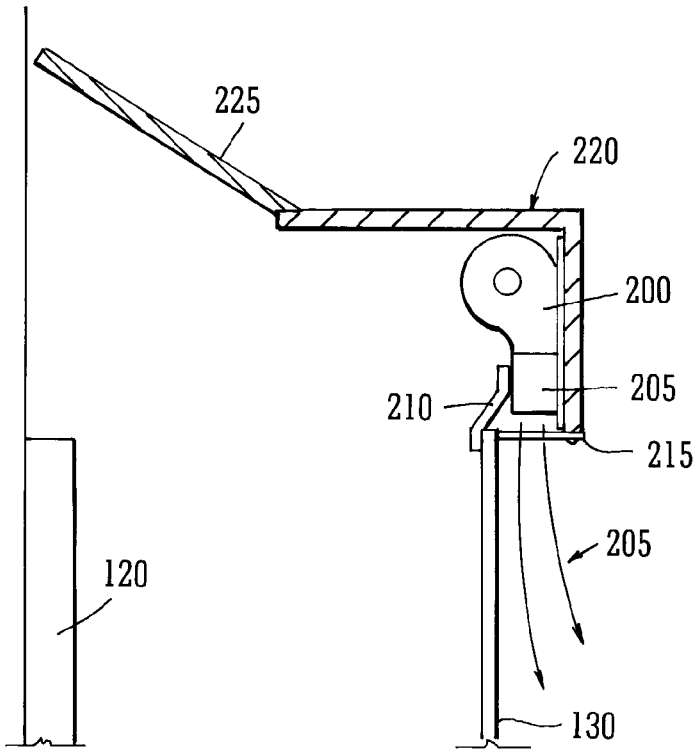
FIG. 2 is a section through a portion of the fire of FIG. 1.

As shown in FIG. 2, the fire may include one or more air heating elements 205 configured, in cooperation with an air blower 200, to blow heat downwardly over the side walls. To obviate the possibility of the generated heat interacting with and disrupting the flame effect, a baffle 210 may be provided between the interior volume 110 of the fire and the air blower 200. A grille 215 may be provided to prevent damage to or by the heating element 205. The heating element is desirably provided in an upper portion 220 of the housing, and the fire may include a moulding 225 dimensioned to resemble a gas outlet.

Figure 3:
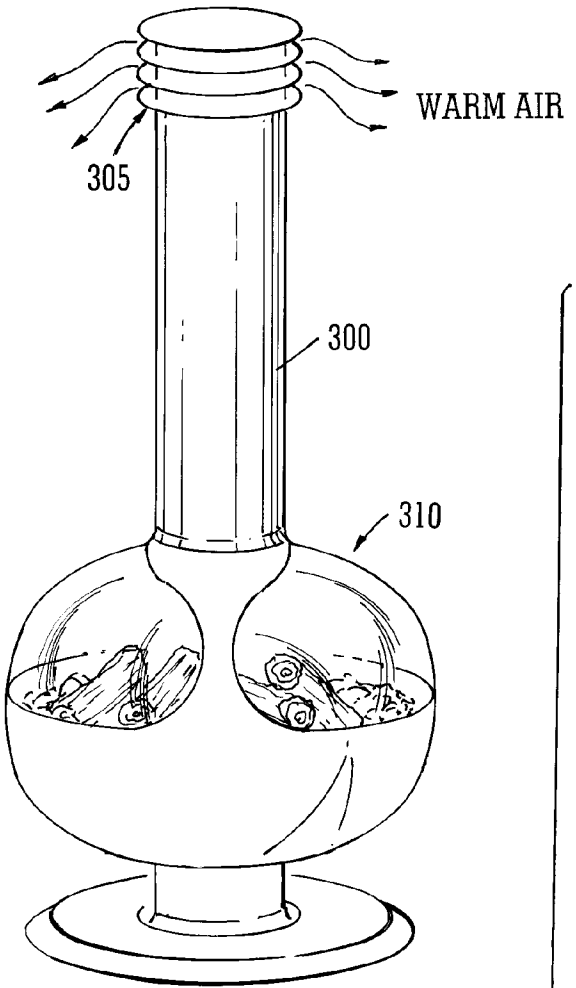
FIG. 3 is a perspective view of a free standing fire provided in accordance with the teaching of the invention.

In a modification to the fire of FIG. 1, shown in FIG. 3, the moulding 225 is dimensioned to resemble a chimney 300 and includes an air blower provided therein. The air blower, in combination with a heating element similarly to that shown in FIG. 2, generates heat which passes upwardly through the chimney and out through one or more vents 305 which are arranged circumferentially about the chimney. In this way a heating of the environment around the periphery of the fire is provided. Prior art electric fires only provided heat forwardly of the fire and not circumferentially about the periphery of the fire. By providing such a heating arrangement it is possible to provide the fire in a free standing arrangement where a user can walk around the fire. While the use of an air heater including a blower is advantageous, it will be understood that other types of heaters such as radiant heaters can be also used to heat the chimney and cause an emission of heat circumferentially about the heater.

Such a fire, similarly to that of FIG. 1 includes a flame effect generator provided within a housing 310 and being configured to operatively generate a flame effect with said housing. The chimney however is arranged to project above and extend from the housing. The air heated by the air heating element may exhaust the fire through the vents as opposed to downwardly over the front screens. Such a fire is especially useful as a standalone fire, although of course it could be configured as an inset fire for other installations. By providing a vent in the chimney—desirably located in an upper region thereof and extending at least partially about the circumference of the chimney, it is possible to distribute heat generated within fire about the housing of the fire as opposed to preferentially directing the generated heat forwardly of the fire. Furthermore as the heating element is located within the chimney, its effects on the generated flame pattern below is minimised. The use of a flame generator which provides a three dimensional flame which is visible from all sides of the fire is particularly advantageous for this type of free standing fire as irrespective of the viewer's location relative to the fire they will get to appreciate the generated flame.

Figure 4:
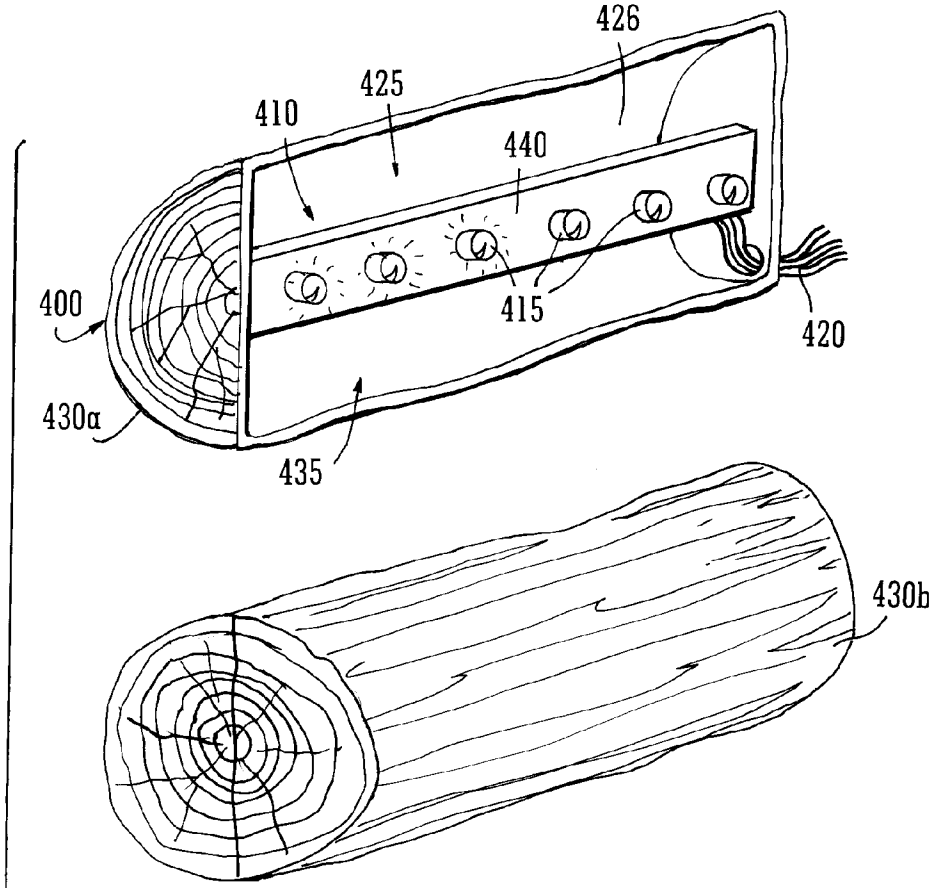
FIG. 4 is an example of a fuel element provided in accordance with the teaching of the invention.

FIG. 4 shows an example of a fuel bed element 400 for use in the fuel bed of an electric fire—such as the fuel bed 116 of FIG. 1. While the fuel bed element may be used in the context of a simulated electric fire that provides a three dimensional flame, it will be understood that the fuel element could be used in other types of electric fires. In this exemplary arrangement the element is configured to resemble a log, but it will be appreciated that any configuration could be useful within the context of the teaching of the invention. By providing the element with a plurality of independently operable light sources 410 it is possible to selectively activate individual ones of the light sources. Such a fuel bed element may be usefully employed within a fire and used to simulate one or more fire effects. The arrangement of FIG. 4 includes a number of individual LEDs 415 which are coupled via an electric coupling 420 to a controller (not shown in the Figure) which is elsewhere located within the fire. The individual LEDs 415 may be mounted on a mounting board 440 prior to coupling the LEDs onto the fuel element. The controller is useful for controlling operation of the independently operable light sources. The controller is desirably configured to provide a spatially varying lighting effect within the fuel element such that one or more flicker or pulsating effects may be generated within the fuel bed element. As shown in FIG. 4, a first combination 425 of the LEDs is set to come on when a second set 426 is not. This sequence of selective activation can achieve a number of different effects such as pulsating or the like of the fuel bed element. Desirably the fuel bed element is formed from two or more parts, 430*a*, 430*b*, which separate to define an interior portion 435 where the light sources may be located. Once located, the parts are reassembled to define a complete element. Such construction can be considered similar to that described in our earlier application PCT/EP2007/002207, but differs in that in this arrangement individual ones of the light sources are independently controlled with respect to others. In PCT/EP2007/002207, no such control was possible. However similarly to that described in PCT/EP2007/002207, the light sources could be fibre optics that are optically coupled to a light source remotely located from the fuel bed. In this arrangement a number of different light sources would need to be coupled to different ones of the fibre optic ends to achieve the individual lighting of this embodiment.

In this way it will be appreciated that the specifics of the independently operable light source is not important in that any lighting arrangement that provides for a plurality of individual controlled light sources within a fuel bed element may be considered as falling within the teaching of the present invention. In all such arrangements it is considered likely that lighting connections between the fuel bed element and the controller/light sources that is used to effect illumination will be required. In such arrangements, an element remote from the fuel bed element is required to effect operation of the independently operable light sources, and a connection between this element and the fuel bed elements may be required.

Figure 5:
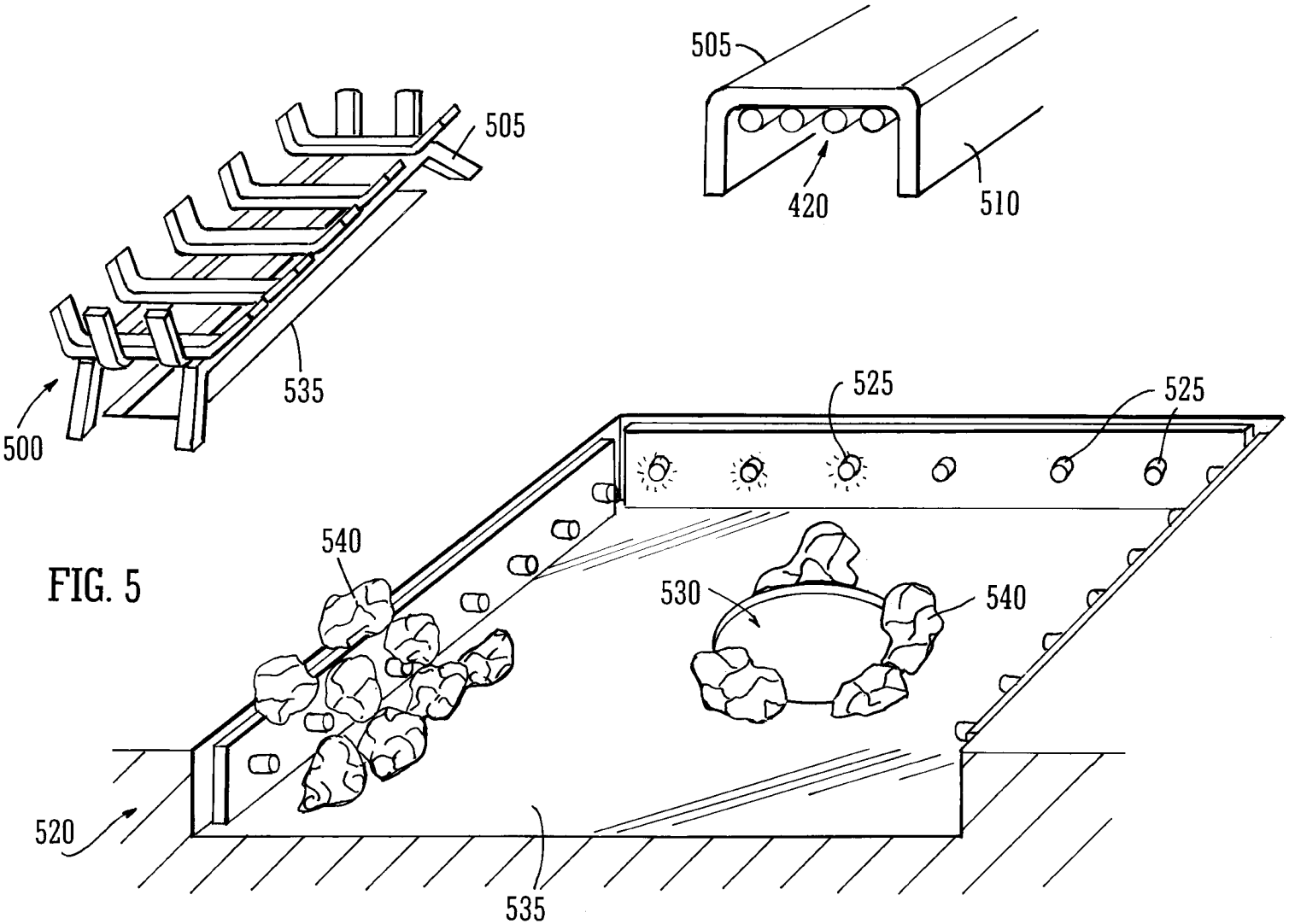
FIG. 5 is a schematic showing a fire grate and ash tray that may be employed in conjunction with the fuel bed element of FIG. 4.

To facilitate such an arrangement and as shown in FIG. 5, such a fire may include a fire grate dimensioned to receive one or more fuel bed elements. The grate is locatable within the housing of the fire and is shaped to provide a concealed path for lighting connections 420 to the fuel bed element that are provided within the grate. Such shaping may be achieved by providing individual legs 505 of the grate 500 with an arcuate surface 510 which is shaped to provide the concealed path necessary. When routed through the concealed path, the connections 420 are not visible to a viewer above the grate. An alternative arrangement may include the provision of hollow legs within which the connections may be threaded.

Such a fire may additionally include an ash tray 520 within which the grate is receivable, the ash tray including at least one lighting element 525 to generate a lighting effect visible within the ash tray. The ash tray lighting element will emit light that will appear to originate within the ash tray. By providing separate lighting for the ash tray and the fuel bed it is possible to create a differentiation in lighting across a vertical axis of the fuel bed. The lighting of the fuel bed elements may be configured to illuminate at a higher luminosity to that of the ash bed lighting elements such that the visual effect of a glowing ash and burning fuel bed element is effected. By enabling independent activation of different lighting elements within the fuel bed the overall visual effect of the fuel bed is improved. Again, in a fashion similar to that described with reference to the fuel bed element, individual ones of the lighting elements 525 of the ash tray may be grouped with other ones to achieve a selective illumination of differing portions of the ash tray. This may be useful to achieve different lighting effects such as a random or pseudo random sequence about an edge perimeter of the ash tray.

As was discussed above, fires which are useful within the context of the present invention may include a vapour generator which is used to simulate three dimensional flame effects. While the fuel bed element and ash tray configuration that has been described with reference to FIGS. 4 and 5 may be usefully employed in other types of fires, it can be particularly successfully employed within the context of such a three dimensional flame effect fire. In this arrangement, it is usual that the vapour generator be located below the fuel bed such that generated vapour will pass upwardly through the fuel bed. The ash tray of FIG. 5 is shown modified for such use in that it includes at least one aperture 530 defined in a lower surface 535 thereof and providing an outlet into the ash tray for vapour generated by the vapour generator.

The ashtray may include a number of fire debris elements 540 locatable within the ash tray to at least partially occlude viewing of at least one of the lighting elements 525 and/or aperture 530. The debris elements may includes one or more reflective surfaces to reflect light elsewhere generated within the ashtray.

Figure 6:
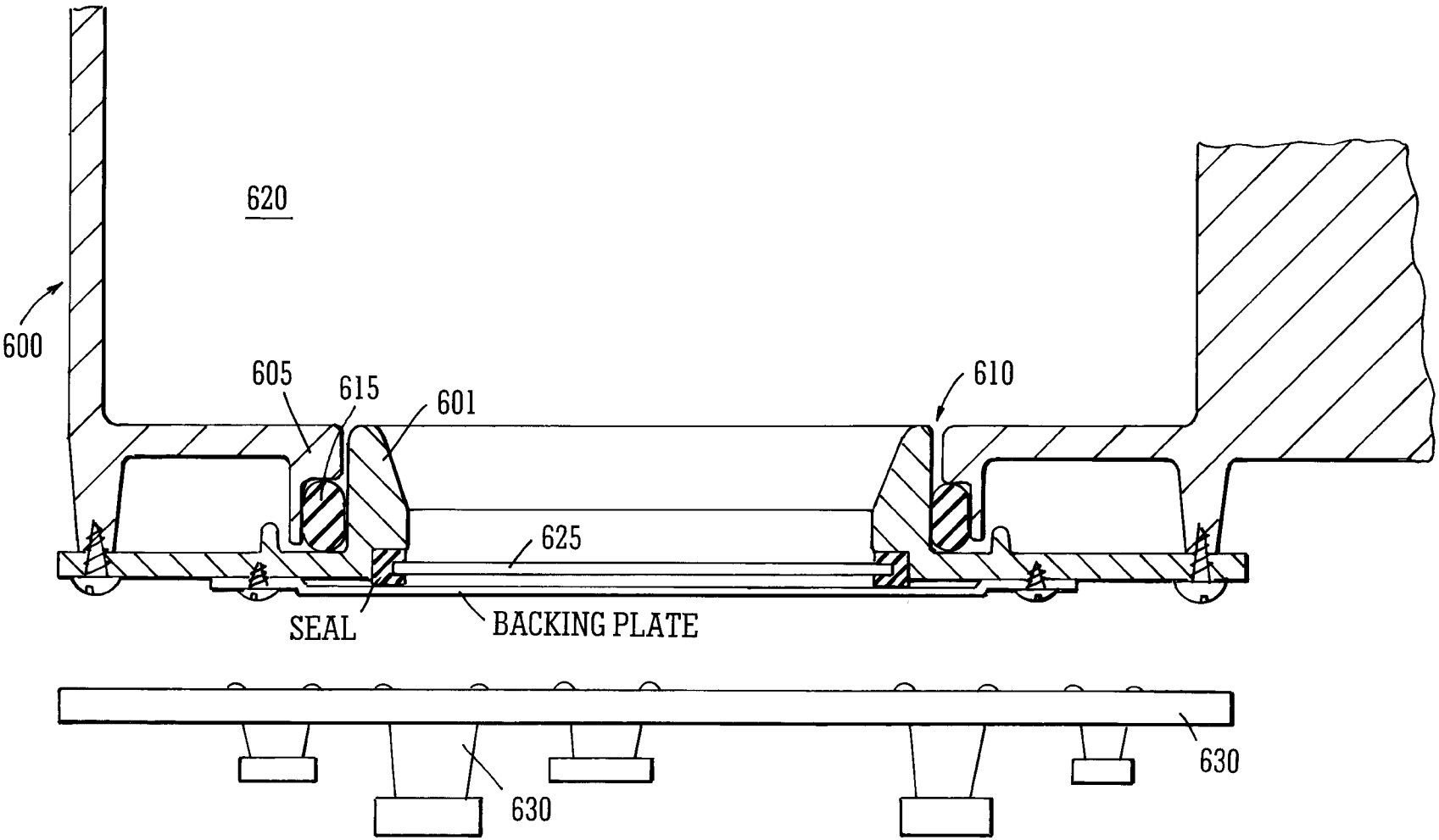
FIG. 6 is an example of a mist generator arrangement that may be usefully employed with fires in accordance with the teaching of the invention.

As was discussed above a fire in accordance with the teaching of the present invention may optimally employ a vapour generator to effect generation of a mist which in combination with judicious lighting may simulate flame effects. Examples of suitable vapour generators include those implemented using ultrasonic transducers such as those described in our earlier case PCT/EP2007/002207, high pressure systems such as those described in PCT/IL01/01217 or a rotary mist generator such as that described in U.S. Pat. No. 7,150,414 or any other suitable variant. Such mist or vapour generators typically interact with a water or other fluid supply to effect formation of a mist. FIG. 6 shows an example of a portion of a suitable mist generator 600—implemented using an ultrasonic transducer. In this arrangement a transducer 601 is removably fitted to a base portion of a container providing a fluid reservoir 605. An aperture 610 corresponding in dimension with the transducer is formed in the base portion of the reservoir. By presenting the transducer to that aperture and sealing it against the base portion, by means of O-rings 615 or some other suitable sealing mechanism it is possible to define a receivable volume 620 within which a liquid will be maintained. Once a liquid is introduced into the reservoir, an ultrasonic disc 625 is in fluid communication with that liquid. Vibration of the disc at a suitable frequency will effect generation of a mist which will depart from an upper surface of the liquid within the reservoir.

The frequency or amplitude of vibration of the transducer may be modified by use of a suitable control circuit 630 coupled to the transducer. It is possible to judiciously control the output of the transducer to adjust the volume of mist generated by the generator. By judiciously selecting the volume of mist generated it is possible to control the amount of vapour that is used to create flame effects. By reducing the amount of vapour, the overall impression is of less flames, whereas by increasing the volume of mist generated per a given time period it is possible to increase the perceived number of flames. Such a controller may be used to continuously adjust the volume of mist generated. The control of the volume of vapour generated may be also useful in achieving a variance in the height of a generated flame or smoke effect. It will be understood that while the mist generator described with reference to this control feature has been specific to a transducer arrangement that other suitable means of controlling the operation of alternative mist generators could also be employed within the context of the teaching of the present invention.

Figure 7:
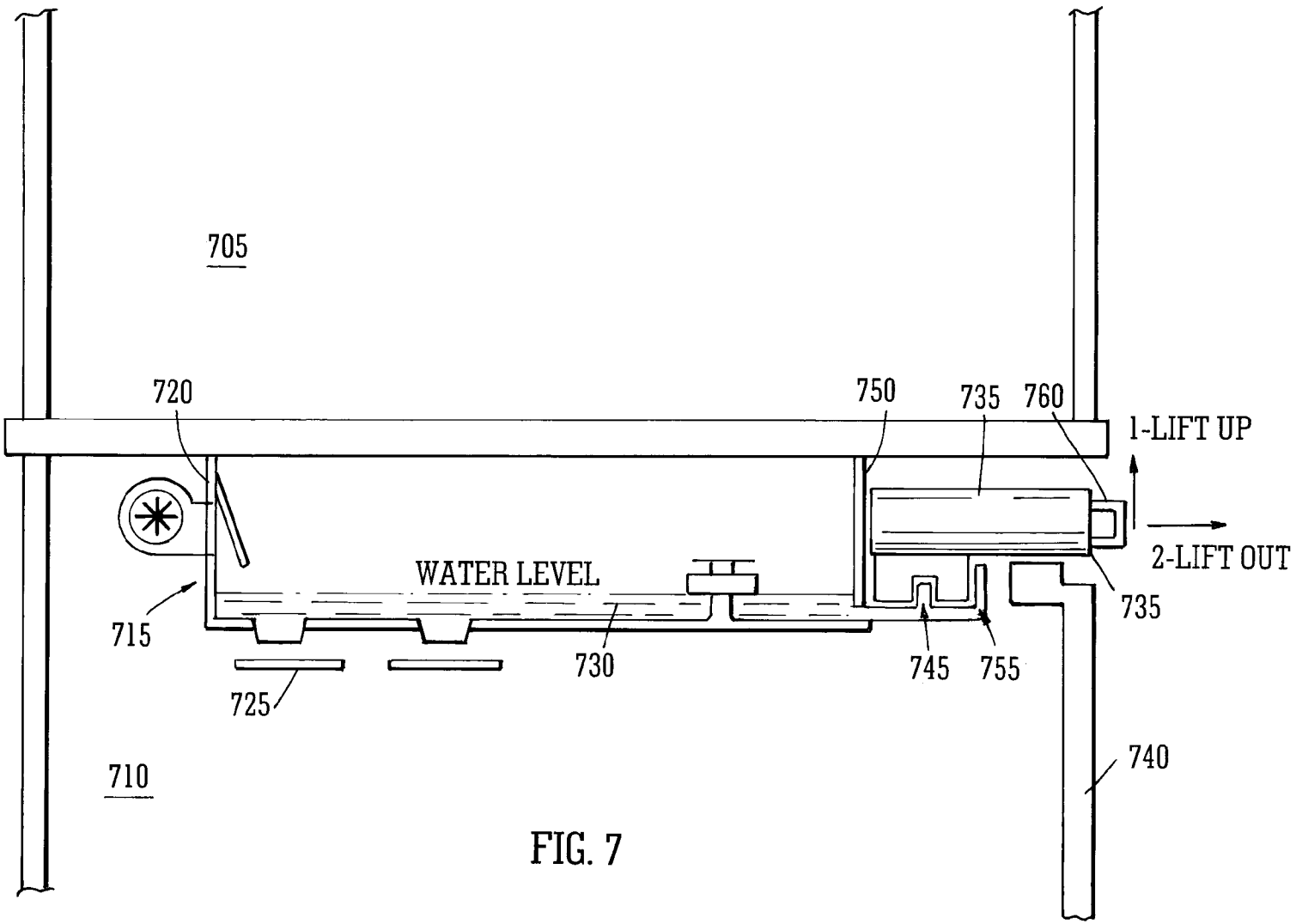
FIG. 7 is a schematic showing a first and second reservoir arrangement that may be considered useful for providing fluid to a mist generator provided in accordance with the teaching of the invention.

FIG. 7 shows a portion of a fire housing useful within the context of an embodiment of the present invention. In this arrangement, the housing 700 has an upper portion 705 and a lower portion 710. A mist generator 715 is provided in the lower portion 710 such that mist generated will pass upwardly into the upper portion where it may suitably be combined with lighting to achieve flame effects. The mist generator will typically be provided below a fuel bed which is locatable within the housing so as to separate the lower and upper portions of the fire. In this exemplary arrangement the mist generator is shown as having a first reservoir 720 from which mist may be generated. Within this first reservoir is provided the one or more ultrasonic transducers 725 which are configured to operatively induce the generation of a mist from the surface of liquid 730. The mist generator of this arrangement also includes a second reservoir 735 in fluid communication with the first reservoir 720. The first reservoir includes a fan element 770 that on activation provides a distribution of the mist away from the surface of the liquid within the reservoir. It is desirable that the first reservoir is permanently positioned within the housing—once it is inserted and mounted to the housing it is not intended to be removed. In contrast, the second reservoir is provided as a removable reservoir which the user can take away from the fire housing to achieve a refilling of the reservoir with a suitable fluid—such as water. On reinsertion of the second reservoir into the housing a flow of liquid from the second reservoir to the first reservoir ensures that the volume of liquid within the first reservoir is sufficient to achieve generation of a mist—in the example of using the ultrasonic transducers as the means for mist generation this will require a covering of the ultrasonic discs. In this exemplary arrangement, the second reservoir is slideably removable from the fire through an opening provided in a side wall 740 of the housing. By enabling a presentation of the removable second reservoir through the side wall of the fire, access to the fire is improved. By obviating the need to present the second reservoir vertically into the fire, it is possible to locate the second reservoir in a lower portion of the fire, adjacent to the first reservoir thereby freeing up space in the upper portion for other elements of the fire. Such an arrangement is also advantageous for ease of engaging the second reservoir within the housing.

A valve 745 may be provided in the second reservoir, the valve being operable to enable a control of the flow of liquid from the second reservoir to the first reservoir upon receipt of the second reservoir within the housing. Such a valve is also useful in obviating any leaking of fluid from the second reservoir during transport.

As the second reservoir is accessed through a side wall of the fire it is possible that it could be accidentally dislodged from the fire. To minimise such a possibility a locking element for retaining the second reservoir within the housing may be provided. In the arrangement of FIG. 7, the locking element is formed from an integrally formed locking arrangement within the housing. A side wall 750 defines the depth at which the second reservoir may be inserted into the housing. On achieving abutment of the reservoir against the side wall, it is possible to then lower the reservoir vertically into engagement with a receiver 755 to achieve a complete locking of the reservoir within the housing. It will be understood that by providing such a locking arrangement disposed within the housing, that insertion or removal of the second reservoir requires a two step action—one step a movement in a horizontal plane and a second step in a vertical plane. The provision of such a locking arrangement minimises the possibility of an accidental removal of the second reservoir from the housing. To assist in a removal of the reservoir, it is desirably provided with a handle 760 that may be integrally formed on an outer surface of the reservoir.

Where one or more reservoirs are used in the generation of a mist it is important to maintain a supply of liquid for operation of the mist generator. There is therefore the possibility that during periods of inactivity that the liquid within the reservoir if not treated may become stagnant. The present inventor has addressed this problem by provision of a filter for filtering the liquid. Such a filter usefully provides for a control in calcification or other effects which may degrade the performance of the mist generator. The filter may also or alternatively be employed to control biological growth within the reservoirs. The filter may be disposed between the first and second reservoirs. Alternatively or in addition the filter may be located in the first reservoir. Examples of useful filters include those mineral removing filters and/or anti-microbial filters Furthermore the present inventor has realised that the performance of mist generators that employ one or more transducers are dependent on the height of the liquid level above the transducer. The present inventor has realised that especially where two or more transducers are provided within the same volume of fluid that each is operable within the same conditions—i.e. that the head of liquid over each transducer is the same such that the volume of mist generated will be equivalent. To ensure that this is achieved in one embodiment a level indicator may be provided in a region of the fire that is easily accessible by a use. Such a level indicator will provide the user with an indication as to the correct orientation of the reservoir within which the transducers are located, and any deviation from the horizontal plane can be noted by the user and corrected for by altering the height of one region of the fire relative to another.

Within the context of use a generated mist for use in simulation of flames, the present inventor has found that it is important to control the distribution of the generated mist into the interior volume of the fire where it is then visible by a user as a flame. To achieve this control an embodiment of the present invention provides for the provision of a mist buffer or mist reservoir coupled to the mist generator, the buffer serving to control the flow of the mist subsequent to its generation. Such a buffer is typically configured to reduce the flow rate of the mist passing from the generator prior to generation of simulated flames, but could equally be considered as ensuring that an even distribution of the mist is provided into the fire. The buffer provides for a gathering of the mist prior to its distribution into the fire, either directly or via another distribution element.

Figures 8A, 8B, 8C:
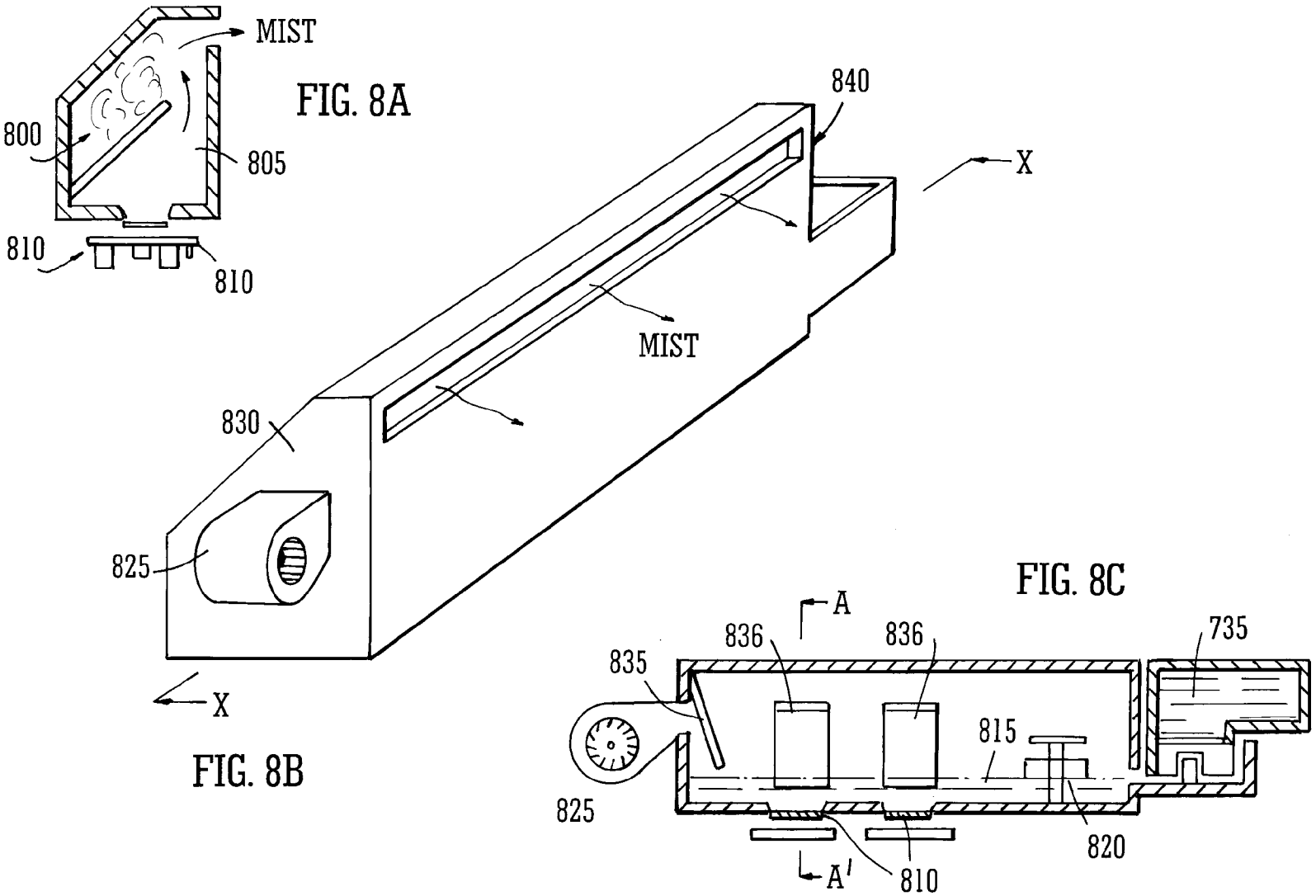
FIG. 8B is a perspective view of an assembled unit.
FIG. 8C is a section through the unit of FIG. 8B along the line X-X' and FIG. 8A is a section through the unit along the line identified as A-A' of FIG. 8C.

FIG. 8 shows an example of a mist buffer or mist reservoir 800. In this embodiment the buffer is integrally formed with the reservoir 805 within which the mist is generated, i.e. the mist generator. The mist generator includes in this exemplary arrangement an ultrasonic transducer 810 provided in a lower portion of the reservoir, the transducer being operatively arranged to generate mist which will rise upwardly from the surface of liquid 815 provided in the reservoir. The arrangement of FIG. 8 makes use of the second removable reservoir described previously with reference to FIG. 7, and control of ingress of fluid from the second reservoir into the first reservoir is effected through use of a water level switch 820 provided in the first reservoir.

In the arrangement of FIG. 8, the container 830 defining the buffer includes a fan mounted in a side wall thereof. The fan is provided to assist in an agitation of the mist contained within the buffer or reservoir. It will be appreciated that the source of agitation could also include other means to introduce air into the buffer—such as a paddle located within the mist reservoir and rotatable so as to create air currents within the volume of the mist generator. A passive means could include a simple ducting arrangement provided in a lower region of the mist reservoir, provided to enable an introduction of air into the reservoir. In the arrangement described, air introduced by the fan 825 is directed downwardly by means of an air baffle 835 onto the liquid 815 to create turbulence effects. Such downward and sideward movement of air across the surface of the liquid serves to uplift the mist that is emitted from the surface and effect an even distribution of the mist across the length of the container. Two or more baffles 836 located above the transducer can minimise large droplets of mist escaping from the container—the droplets will rise from the surface, hit the baffles condense and drop back into the liquid. The driest mist will move upwardly and escape from the buffer through an outlet 840 provided in an upper region of the container 830. The outlet in this exemplary arrangement may be considered a slot in the mist reservoir, the slot being a narrow opening; a groove or slit provided in the casing of the mist reservoir through which the mist within the reservoir may escape. It will be appreciated that the slot of FIG. 8 provides for distribution of the mist in a longitudinal fashion about the longitudinal axis of the slot. While the outlet has been described with reference to a slot and a slot is particularly useful for certain applications in that it provides a long thin narrow emission of mist from the reservoir—akin to a wall of mist, it will be understood that other geometries or arrangements of outlets could also be employed to enable a distribution of the mist from the mist reservoir. Furthermore the outlet could include two or more individual apertures or openings through which the mist may be distributed. Furthermore while the fan of FIG. 8 directs the air into the reservoir along an axis parallel to the longitudinal axis of the outlet slot, it will be appreciated that other orientations of the fan could also be considered useful.

In this arrangement of FIG. 8 the outlet is provided as a single slot on a side surface of the container such that the emitted mist exits sidewardly from the buffer. The slot has a longitudinal axis that is substantially transverse to the direction in which the mist exits the slot. It is desirable for many applications for this longitudinal axis to be substantially parallel with the front of the fire such that the mist will exit across the front of the fire. The longitudinal dimension of the outlet or slot may be comparable with the width of a fuel bed located within the fire such that the mist will have a width substantially corresponding with the width of the fuel bed.

In the arrangement of FIG. 8 it will be understood that the entrance to the buffer (which as the buffer is integrally formed with the reservoir serving the mist generator is the surface of the liquid) is offset from the outlet—the mist enters vertically and exits horizontally. In this way the buffer of this arrangement may be considered a mist reservoir having an inlet in fluid communication with the mist generator, and at least one outlet for providing the mist and wherein the inlet and outlet are offset from one another.

Figure 9:
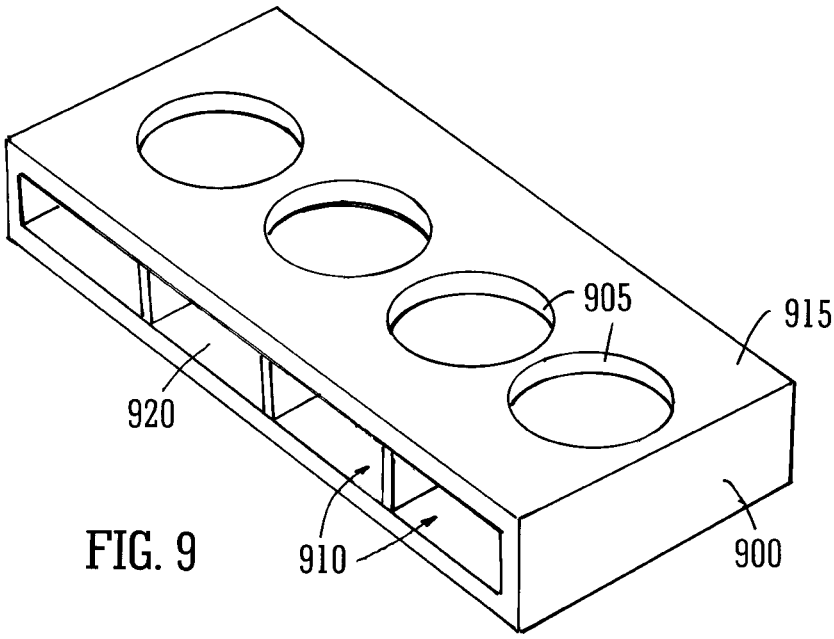
FIG. 9 is an schematic showing a distributor that may be used in conjunction with the mist reservoir of FIG. 8.
Figure 10:
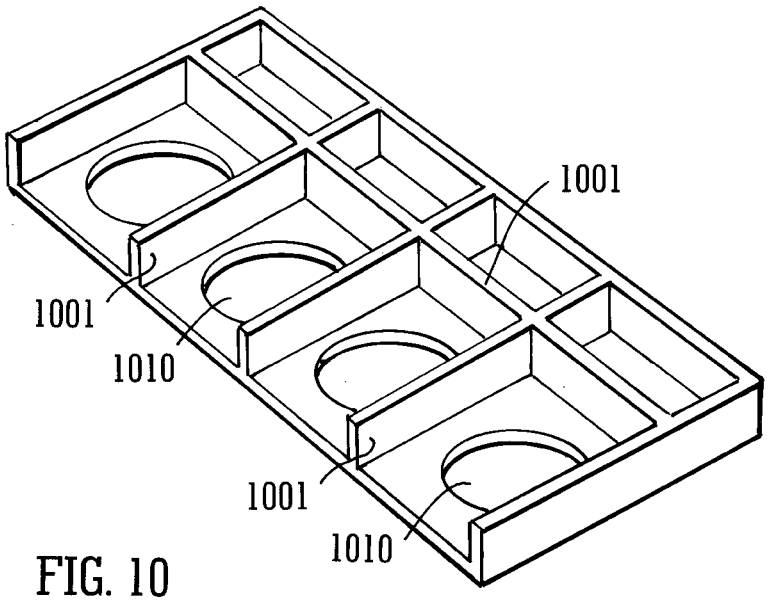
FIG. 10 is a view of the distributor of FIG. 9 with a top cover removed.

While the buffer serves to ensure that an even distribution of mist formed from the generated mist, an embodiment of the invention teaches further distribution. Such an arrangement is shown in FIG. 9 where a mist distributor 900 for distributing the mist from the mist buffer through a plurality of upper apertures 905 provided on an upper surface 915 thereof is illustrated. The distributor includes one or more entrance apertures 910 that are coupled to the output slot from the mist reservoir. Mist enters the distributor sidewardly through the entrance aperture, where, as shown in FIG. 10, its movement is constrained through the provision of one or more interior baffles 1001 prior to escaping upwardly through the exit apertures 905. It will be appreciated from an inspection of FIG. 10, that the distributor 900 includes a plurality of lower apertures 1010—equal in number to the upper apertures provided on a lower surface 920 of the distributor. The purpose of these apertures is to allow the introduction of heated air currents from below into the distributor to create an updraft on which the mist will be carried upwardly.

Figure 11:
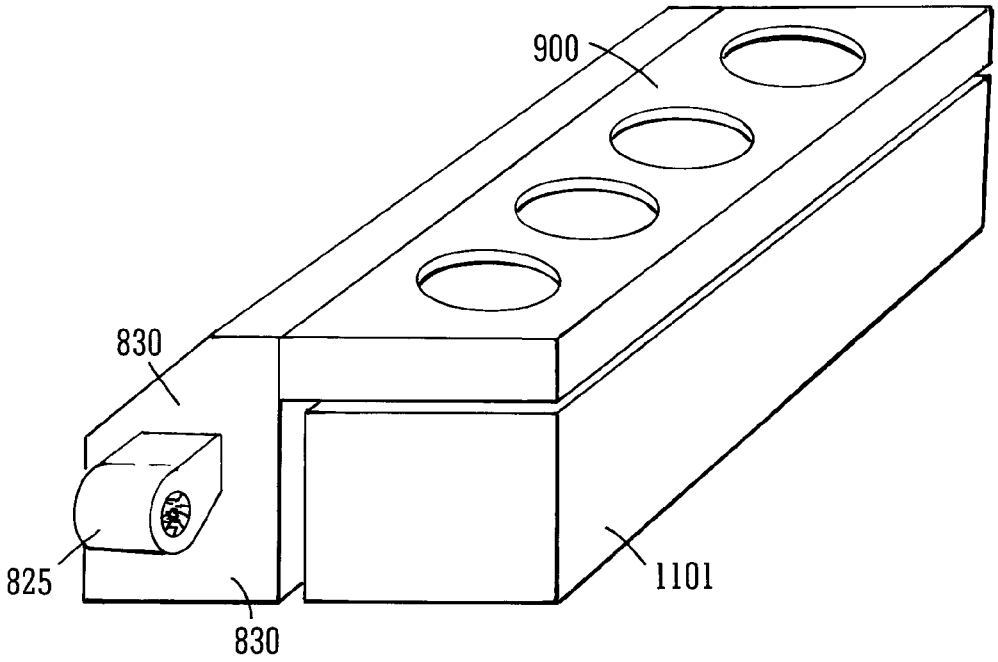
FIG. 11 shows an arrangement for coupling the distributor of FIG. 9 with the mist reservoir of FIG. 8.

As shown in FIG. 11, such heated air currents can be provided by interfacing the distributor above a light box 1101. By locating individual bulbs or light elements within the light box 1101, coincidentally located below the lower apertures of the distributor 900, heat generated from the lights will rise into the distributor and carry the mist upwardly. At the same time, the light from the light sources will be introduced into the mist and will create the flame effect desired. Suitable colouring of the light source be that achieved through use of filters or by selection of coloured lighting can achieve different flame effects.

Heretofore the mist generator coupled to the buffer or mist reservoir has been described with reference to a transducer but any other type of mist generator may be considered useful within the context of the teaching of the present invention. This will particularly be understood later on when the provision of a mist gathering unit or mist reservoir coupled to a mist generator in the form of a high pressure unit which uses pressures in excess of atmospheric pressure to generate mist or vapour effects will be discussed.

While the provision of a mist generator of different form has been discussed herein, it will be understood that the invention is not to be construed as being limited to any one specific form of mist generator. Furthermore, the present inventor has realised that by providing two or more active elements to effect generation of a mist and by operating them in a redundant fashion that it is possible to achieve a lengthening in the operating lifetime of the mist generator. Such redundancy can be achieved through selective activation of individual ones of the active elements be that an alternating selection of a first followed by a second followed by the first again, or by operating a first for a first time period then using the second element once performance of the first is degraded somewhat. Such operation in a redundant fashion will be particularly useful in the context of cleaning of the mist generator elements as will be discussed hereinafter.

Figure 12:
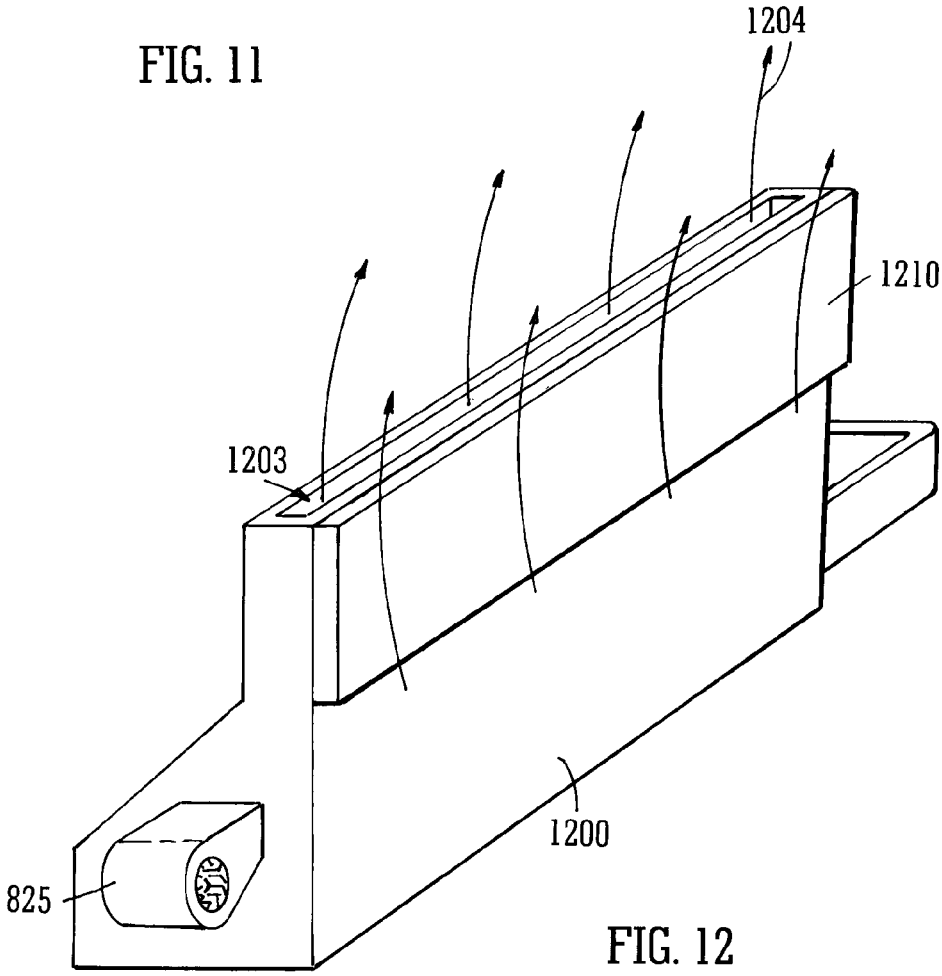
FIG. 12 is a schematic showing an alternative integrally formed mist generator and mist reservoir including a chimney provided in an upper surface of the mist reservoir.

Heretofore the generation of the heated air currents which are used to lift the generated mist upwardly has been considered in the context of passing the mist over a light source and then entrapping the mist in that uplifted air arising solely from the heat output of the light. In this fashion it will be understood that the lighting achieved is along same vertical axis on which the mist is travelling—the light and the mist are entwined. FIG. 12 introduces an alternative mechanism for effecting the heated air currents on which the mist will travel upwardly. This mechanism may be used in combination with or independently of heated air from the light sources to create updrafts on which the generated mist will be carried. In the arrangement of FIG. 12, the mist buffer/reservoir or mist gathering unit 830 of FIG. 8 is modified such that a vertical outlet funnel or chimney 1201 is provided through which mist 1204 may exit upwardly from the mist reservoir 1200. This arrangement is similar to that of FIG. 8 in that the mist exits through a slot formed in the mist reservoir, but again it will be understood that while the geometry of a slot is desirable for formation of a mist wall—as will be discussed hereinafter, that other applications may employ outlets of a different number or geometry to that of a slot. The arrangement differs in that the reservoir includes a chimney extending upwardly and within which is defined the outlet. In the arrangement of FIG. 12, the outlet is provided as a slot 1203 having a longitudinal axis parallel to and a length comparable with the length of the reservoir is described but it will be understood that this slot could be subdivided into two or more smaller apertures or that the dimensions could be enlarged or reduced depending on the application. The arrangement shown is however particularly useful in that a mist wall of a substantially continuous extended length is formed. This differs from some of the previous arrangements where the mist was directed upwardly in discrete individual bundles as opposed to one continuous volume. This arrangement differs from that of FIG. 8 in that in use the mist will exit from the slot directly upwardly into the fuel bed whereas in FIG. 8, the mist was routed from the reservoir through a distributor element prior to distribution into the fuel bed.

To assist the upward movement of the exiting mist, it is desirable that at least one surface of the chimney is heated. It will be understood that the chimney of this exemplary arrangement is formed having a substantially rectangular cross section with the slot provided in the top surface thereof. In the arrangement of FIG. 12, such heating is achieved by coupling an active heating element 1210 to a side wall, desirably one of the longer side walls so as to achieve heating of a greater area of the funnel. Typically the heating element is in the form of an electrical heating element. By fabricating the funnel in a thermal conducting material such as a metal for example aluminium, heat introduced by the heating element 1210 will be efficiently distributed through the walls of the funnel to heat the mist passing upwardly from the interior of the reservoir.

Figure 13:
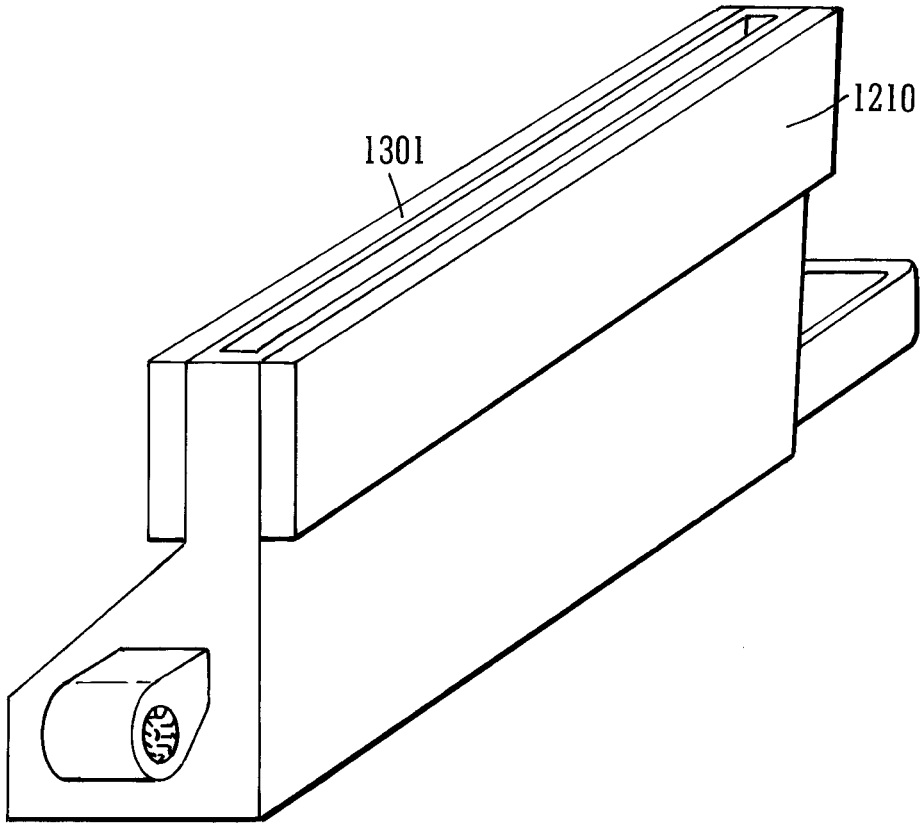
FIG. 13 shows a modification to the arrangement of FIG. 12 to include first and second heated surfaces.

As shown in FIG. 13, multiple surfaces may be heated—in this example a second heating element 1301 is provided on the opposing wall to the first heating element 1210. By heating multiple surfaces or by providing a heating of a first side more than a second side it is possible to change the characteristics of the carried mist. For example if the inner surface—that defined as having the heating element 1210 coupled thereto—is heated preferentially to the outer surface—that having the heating element 1301 coupled thereto, it is possible to preferentially direct the exiting mist away from the axis defined by the funnel aperture 1203. If any lighting elements are located proximal to that inner surface the exiting mist will be preferentially directed towards said lighting elements. Any heating method can be considered suitable and while the embodiments described herein show external heating elements, it will be understood that internally provided heating elements such as resistance wires or the like may be incorporated into the funnel wall during the fabrication of same.

Figure 14:
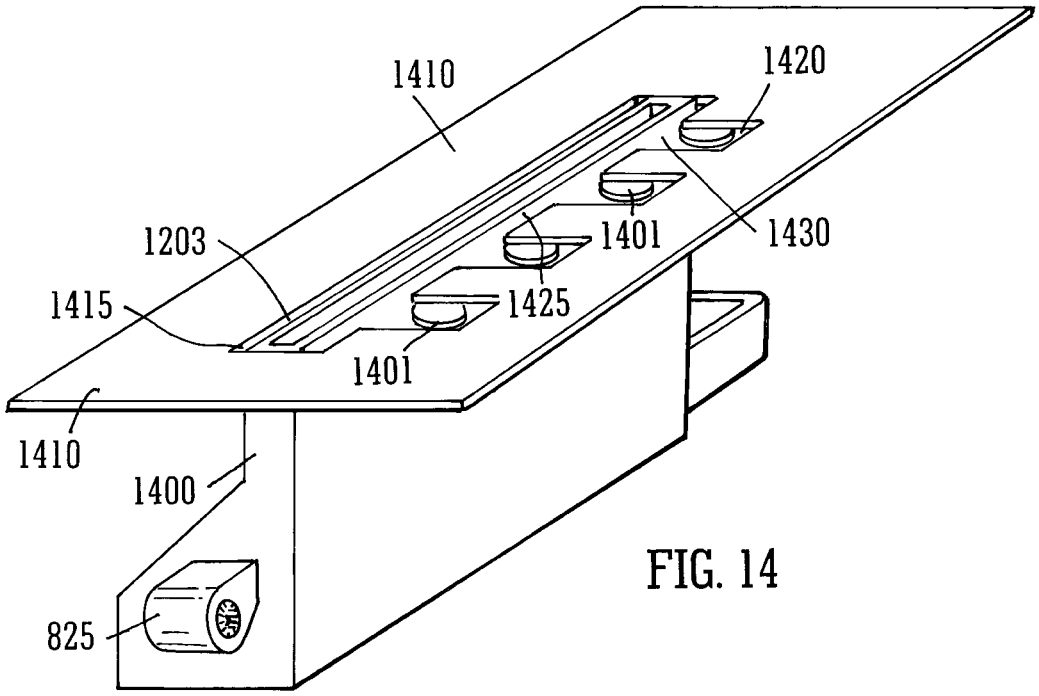
FIG. 14 shows an arrangement for providing a support surface for a fuel bed.

By providing such an exit funnel where the mist exits vertically, it is possible to offset the lighting from the mist such that the light is incident onto a side of the mist as opposed to being entwined within the mist. FIG. 14 shows such an example where a light source 1401 offset from the outlet funnel 1400 is provided and which will provide a light output directed onto the side of the exiting mist. The light source 1401 of FIG. 14 is located adjacent to the outlet funnel such that the light is directed upwardly onto the side exiting mist. Depending on the proximity of the light source to the exit funnel and the heat output of the light source it is possible that thermal convection currents from the lighting may assist in the uplift of the mist. This may be sufficient to carry the mist upwardly or where active heating elements such as those shown in FIGS. 12 and 13 are used may supplement and assist the thermal currents already generated.

Figure 15:
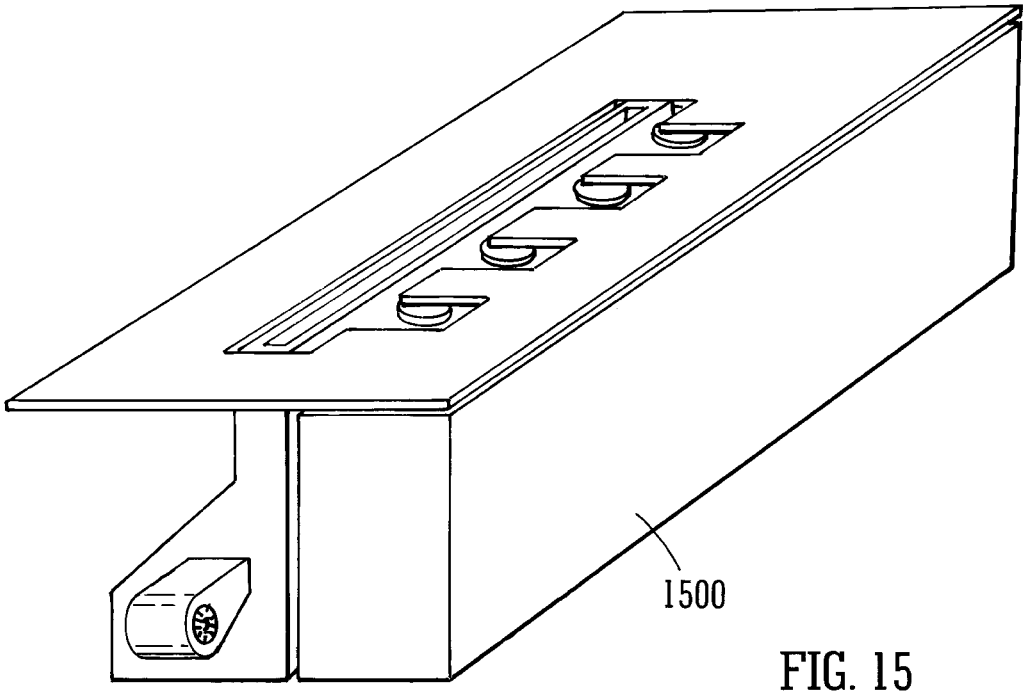
FIG. 15 shows the arrangement of FIG. 14 coupled to a light box.
Figure 16A:
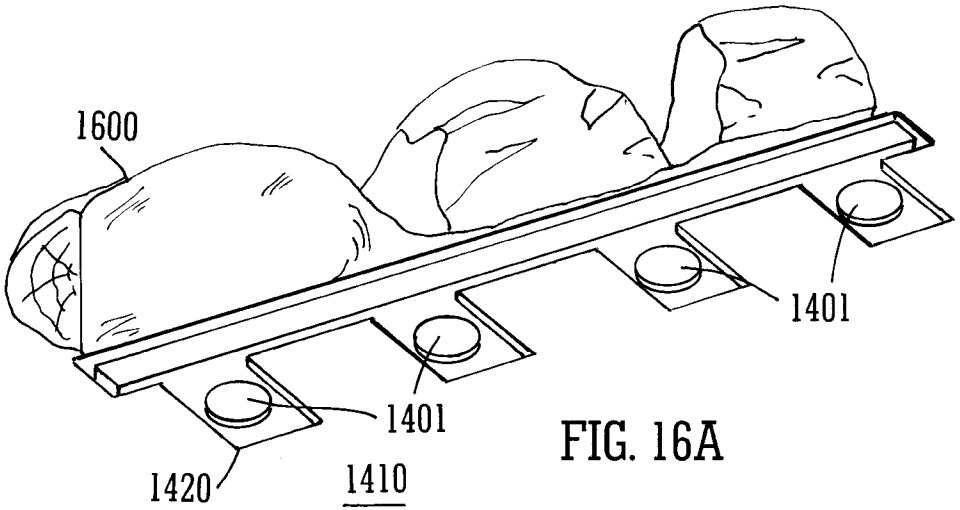
FIG. 16 shows examples of how fuel elements may be provided on the support surface to hide the outlet of the chimney (FIG. 16A), how warm updrafts may be generated from the lights to assist movement of the generated mist upwardly (FIG. 16B) and how a fire grate may be located on the support surface of FIG. 14 (FIG. 16C).
Figure 16B:
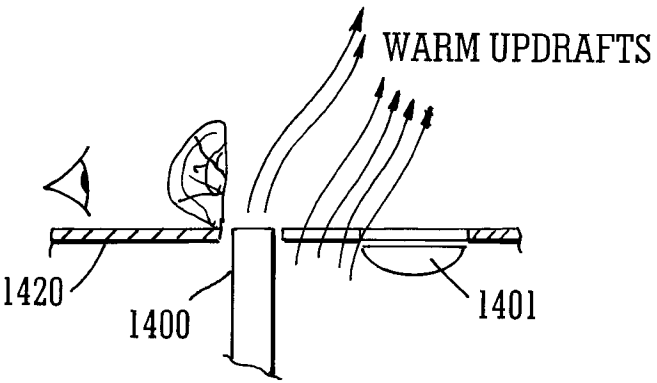

As shown in FIG. 14, the outlet funnel 1400 may be coupled to a planar surface 1410 providing a support for a fuel bed—shown later. In such an arrangement the planar surface will desirably be orientated substantially perpendicularly to the main axis of the outlet funnel such that exiting vapour will pass upwardly through the fuel bed supported on the planar surface. An aperture 1415 is provided within the planar surface 1410 such that the exit aperture of the funnel 1400 divides the surface into different regions. A series of light apertures 1420 are also provided to allow light from the light sources to be directed onto the exiting mist. The aperture 1415 may be dimensioned larger than the dimensions of the funnel 1400 to assist upwardly moving convection currents. In this way gap 1425 may be provided around the outlet slot of the chimney to assist in formation of air currents along the outer surface of the chimney. Additional gaps 1430 may be provided around the light apertures—i.e. the apertures may be formed larger than the dimensions of the corresponding lights to again assist in the formation of air currents FIG. 15 shows the provision of the light box arrangement 1500 coupled to the configuration shown in FIG. 14. The specifics of the mounting arrangements for the bulbs 1401 which were shown schematically as being below the planar surface 1410 of FIG. 14, will be understood as being housed within this light box.

Where the light sources are locatable beside the outlet funnel it is desirable to visually occlude the specifics of the light sources from a viewer to the front of the fire. FIG. 16 shows an example of such an arrangement where two or more simulated fuel element 1600 are provided to the viewing side of the funnel 1400 such that a viewer cannot see the aperture from which the mist exits the funnel. As shown in FIG. 16B, the mist exits the funnel 1400 and moves rearwardly over the light sources where it gets caught in the warm air updraft resultant from the operation of the light source.

Figure 16C:
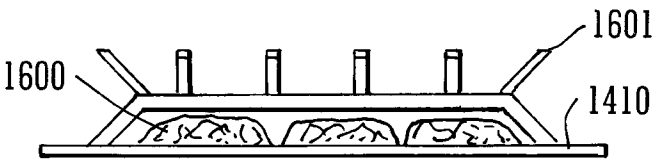

As shown in FIG. 16C, which is a view from the front of a fire, the subsequent location of a fuel grate 1601 on the support planar surface 1410 serves to hide the funnel arrangement even further.

Figure 17A:
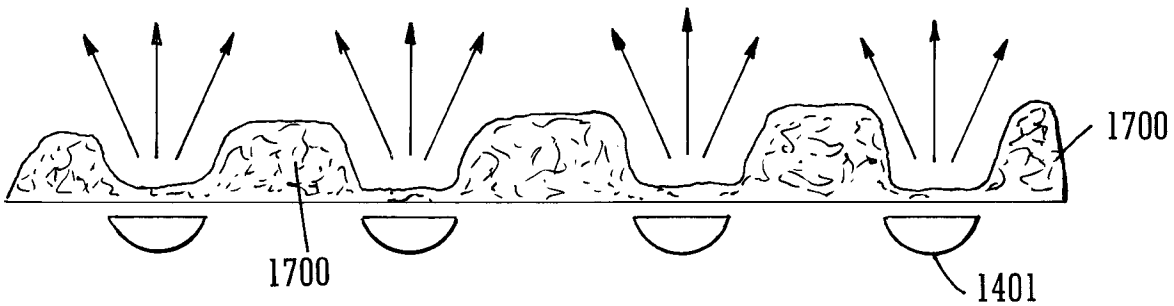
FIG. 17A is a side view showing how the lighting for the mist may be partially hidden from view.
Figure 17B:
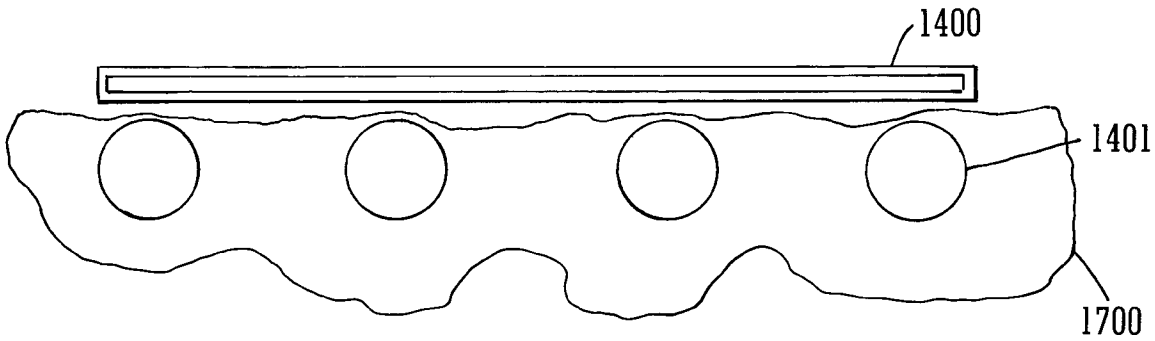
FIG. 17B is a corresponding plan view.

If an active heating element is formed as part of the funnel then the heat output of the light sources is not that important and the light source may be hidden further. Such an arrangement is shown in FIG. 17 where an at least partially translucent moulding disposed over the light sources is illustrated. The moulding may be located over the light sources as shown in the plan view of FIG. 17B and can be suitably formed from a coloured resin or the like. By incorporating independently operable light sources such as LEDs between the dominant light source, it is possible to generate a pulsating lighting effect—similar to that described above with reference to FIGS. 4 and 5.

Figure 18A:
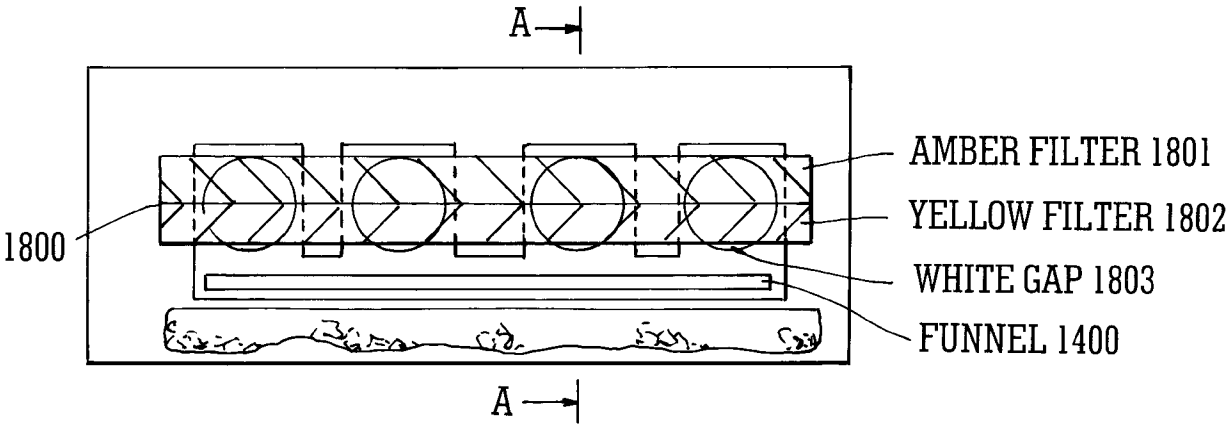
FIG. 18 shows in plan (FIG. 18A) and section (FIG. 18B) how a filter may be used to effect colouring effects of the generated flame.
Figure 18B:
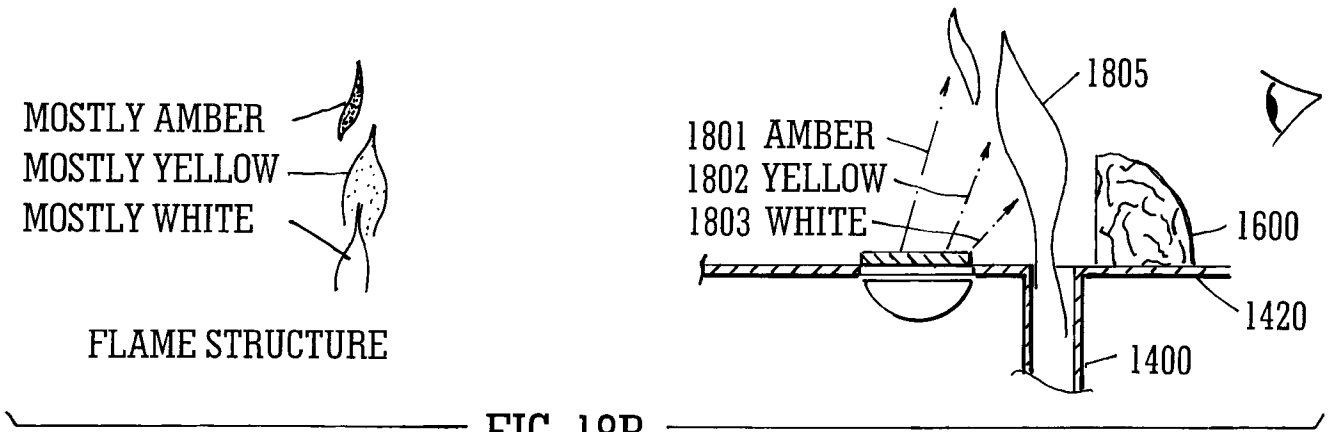

By providing a filtered moulding 1800 such as that shown in FIG. 18 it is possible to incorporate different filters such as an amber filter 1801, a yellow filter 1802 and a white gap and directing the light onto the side of the exiting mist 1805 it is possible to colour grade the vertical generated flame. Such coloured filters can introduce some structure to the flame, e.g. the amber can be preferentially directed towards the top of the flame and the white towards the bottom to more realistically resemble the colouring of a real flame.

By providing for the direction of light onto the side of the mist, preferential lighting of different regions of the vertical mist may be effected. While described with reference to coloured filters and white light, by using a multicoloured light source or by using a plurality of light sources it is possible to colour grade the vertical illumination of the side of the mist such that different regions of the mist are coloured differently to other regions in a similar fashion. By including a plurality of light elements and enabling an individual control of selected ones of that plurality it is possible to create pulsating or flicker effects within the generated flames. As the mist is carried on air currents arising from a heating of at least one surface of the outlet funnel, it is not necessary for the light source to provide the heating of the air current that carries the mist. In such an arrangement it is possible to use low voltage or low wattage lighting elements such as LEDs or the like. Such use of low wattage yet highly efficient light sources may reduces the power requirements of such fires. It is also possible using highly collimated light sources to efficiently preferentially direct light to different regions of the flame.

While the lighting arrangement thus far described has been located to the rear of the fire (i.e. on the side of the funnel remote from the front of the fire such that the light is directed to the rear surface of the exiting mist) and in substantially the same location as the funnel, in an alternative arrangement the light source could be located above the fuel bed and directed downwardly onto the existing mist. Furthermore it could be located to the front of the fire and directed rearwardly onto the front portions of the exiting mist.

Figure 19:
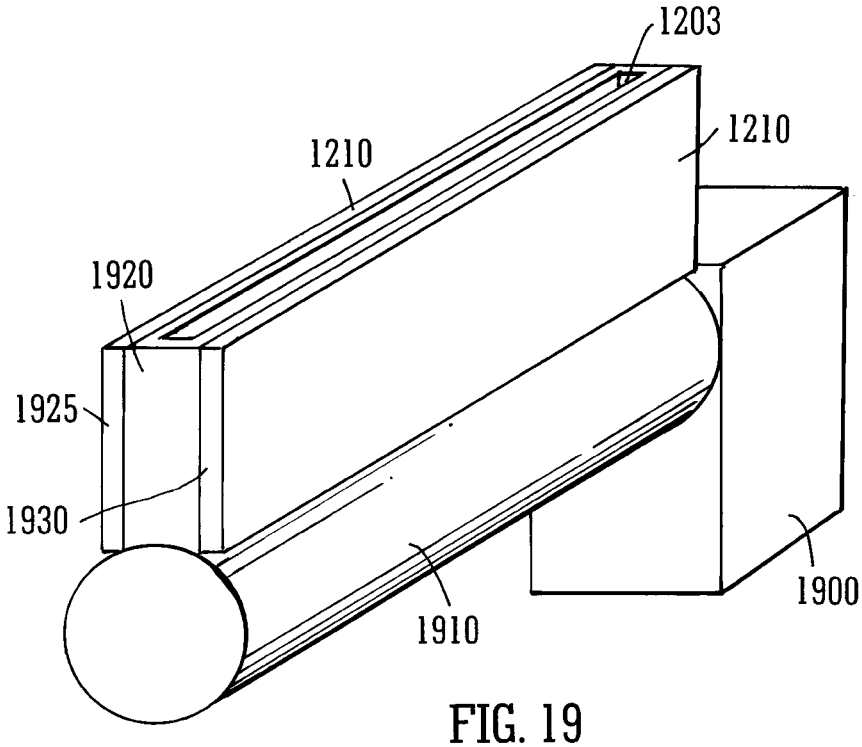
FIG. 19 shows an alternative arrangement where a mist generator and mist reservoir are separately formed.
Figure 20:
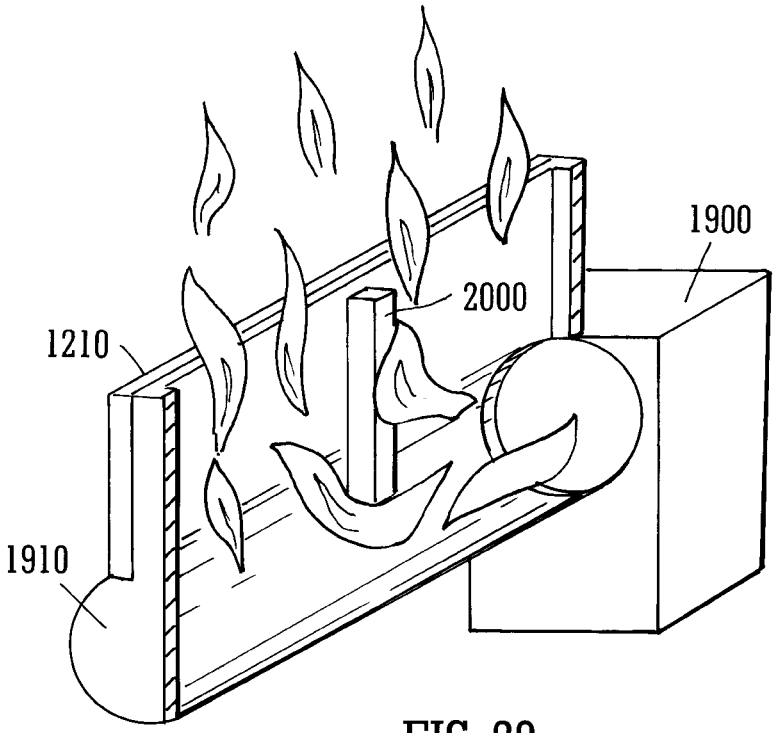
FIG. 20 is a section through the mist reservoir portion of FIG. 19 showing the provision of an internally located baffle.

While the funnel arrangement described above was with reference to a transducer type mist generator, it will be understood that the invention is not to be so limited. As shown in FIG. 19 a mist generator 1900 may be separated from the mist reservoir or buffer 1910—the two are not integrally formed. The dimensions of the reservoir are substantially cylindrical at a base portion, and as shown in the section view of FIG. 20, an internal baffle 2000 may be provided to assist in a distribution of generated mist throughout the buffer 1910. The funnel 1920 provided on an upper surface of the buffer 1910 is shown as having first 1925 and second heated panels 1930, but it will be understood from the discussion above that one or both of these could be omitted.

Figure 21:
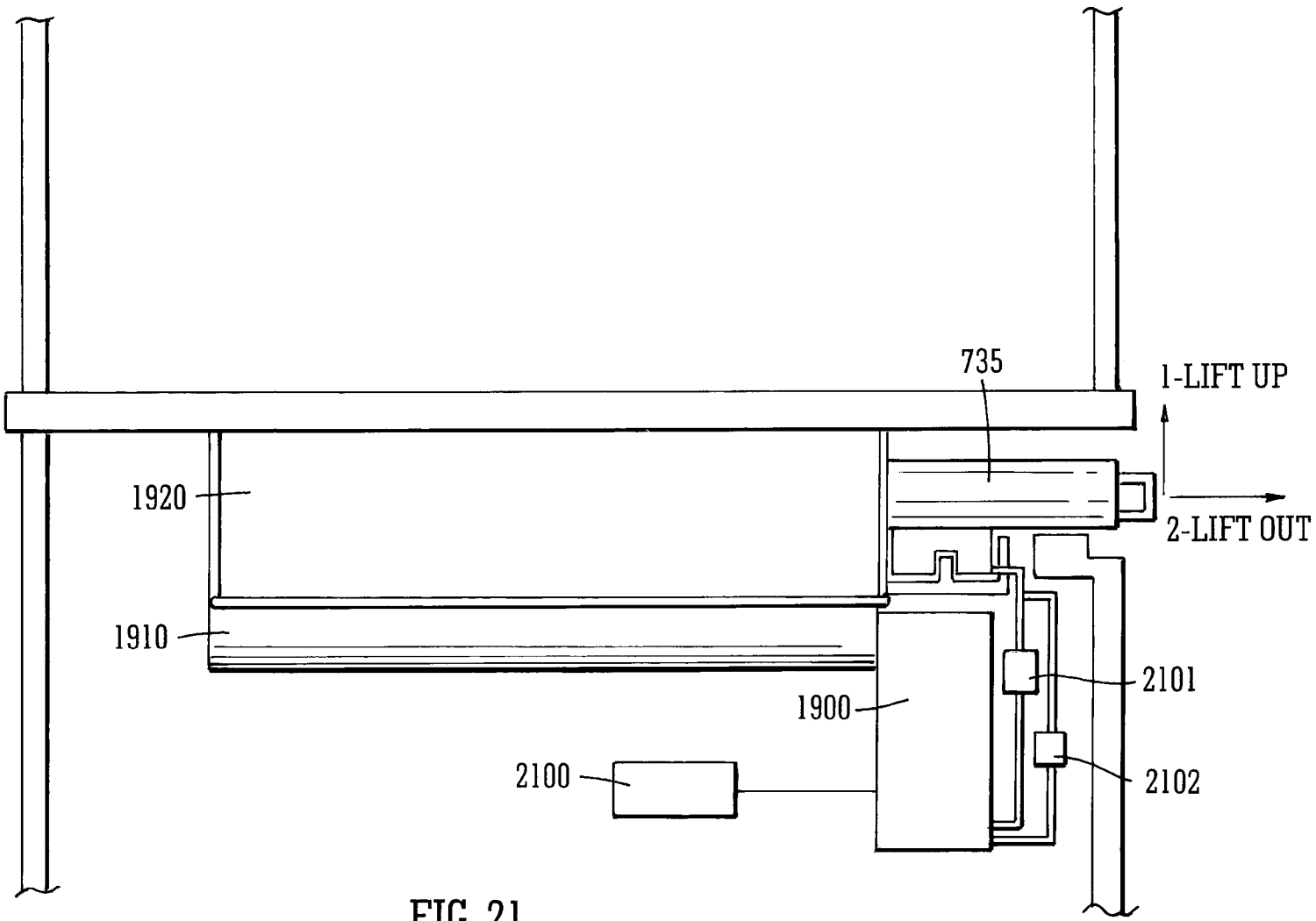
FIG. 21 shows in schematic form how an arrangement such as that shown in FIG. 19 may be incorporated into a fire housing.

FIG. 21 shows how such an arrangement could be located within a fire housing. In this arrangement the mist generator is of the type that provides the mist using high pressure such as that described in PCT/IL01/01217 and as such requires use of a compressor 2100. A second reservoir 735 which is removable such as that described with reference to FIG. 7 is provided in fluid communication with the mist generator 1900. A pump with an actuator 2101 provides for a flow of liquid from the reservoir 735 into the generator 1900 and any excess fluid may be pumped back into the system through use of the pump 2102. In this exemplary embodiment, the mist generator and associated elements are located in a lower region of the housing such that mist that is output will pass upwardly into the housing—where it can be illuminated to resemble or simulate flames.

Figure 22:
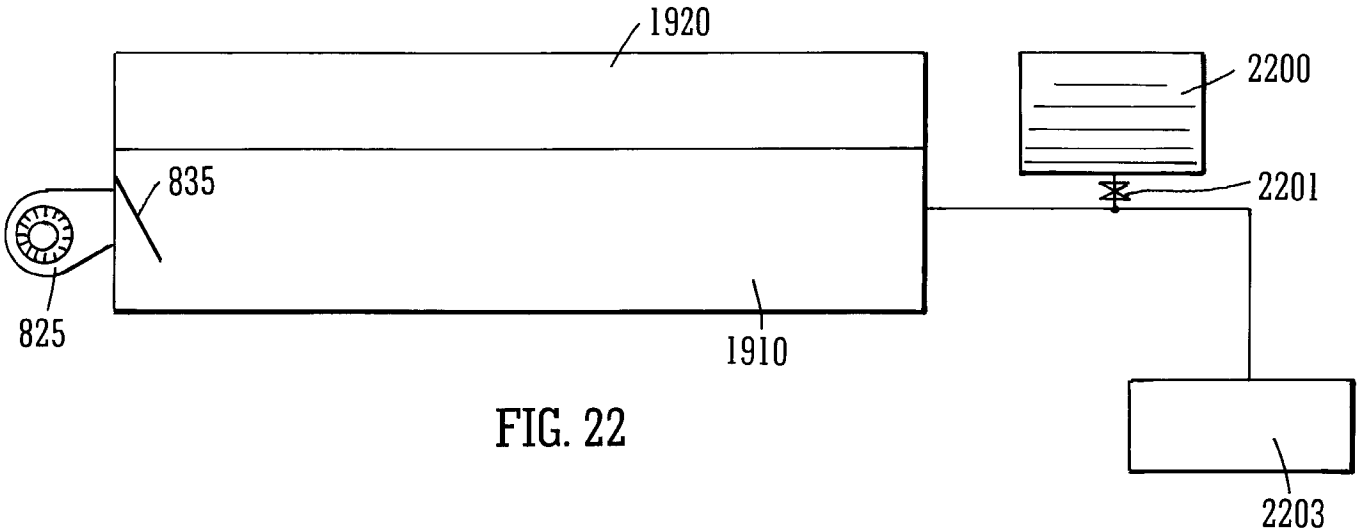
FIG. 22 shows an example of a gravity fed system.
Figure 23:
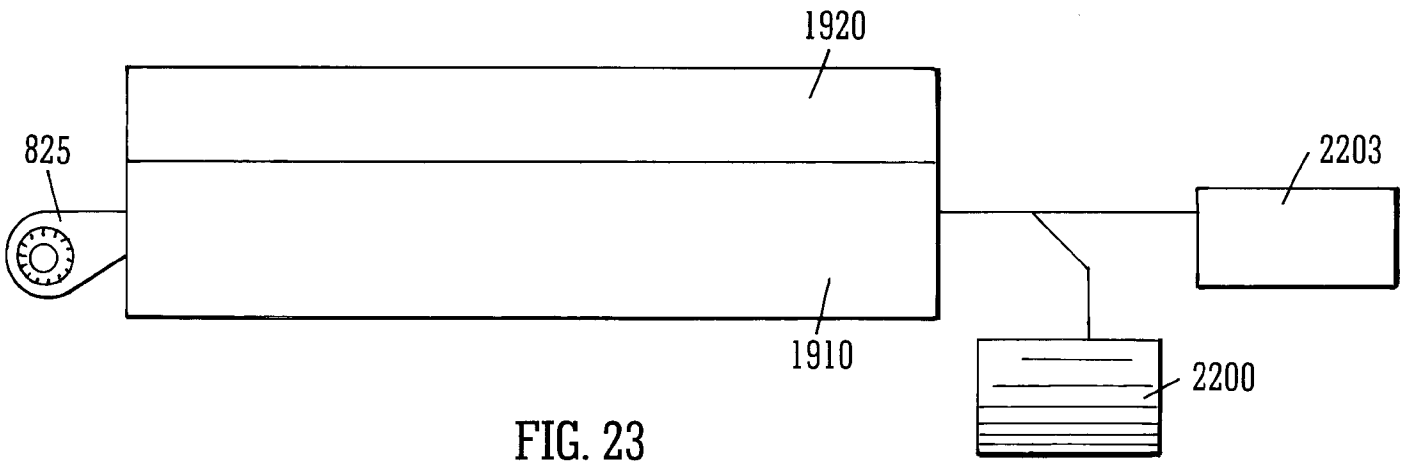
FIG. 23 shows an example of a venturi based system.
Figure 24C:
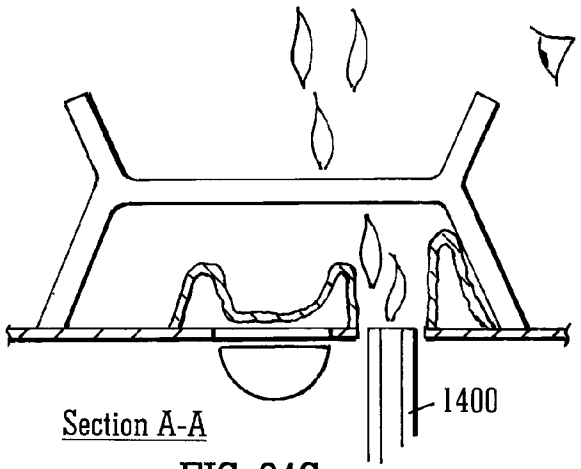
FIG. 24 shows an example of a fuel bed arrangement in accordance with the teaching of the present invention.
Figure 24D:
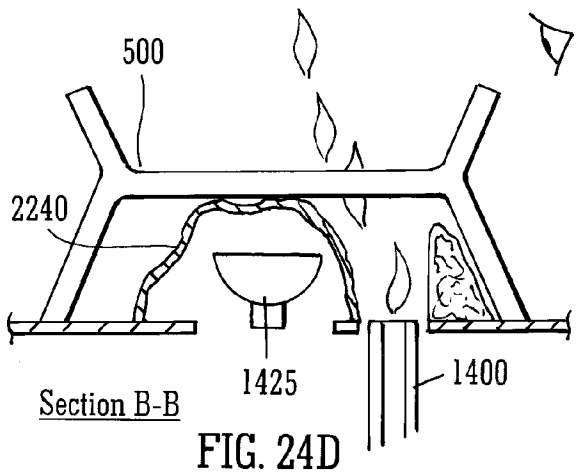
Figure 24A:
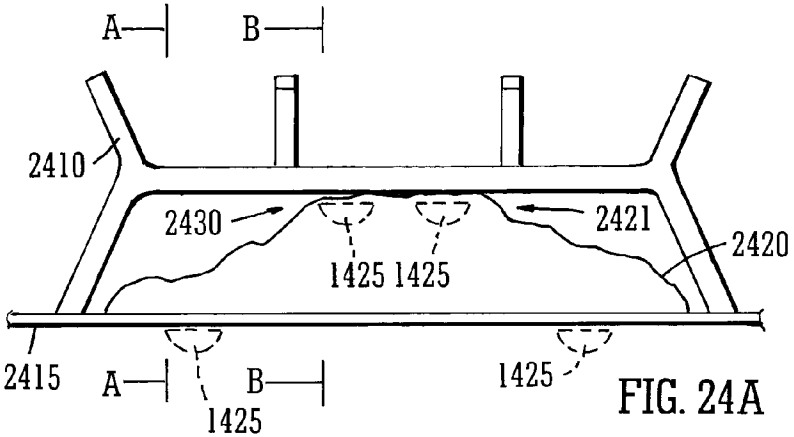
Figure 24B:
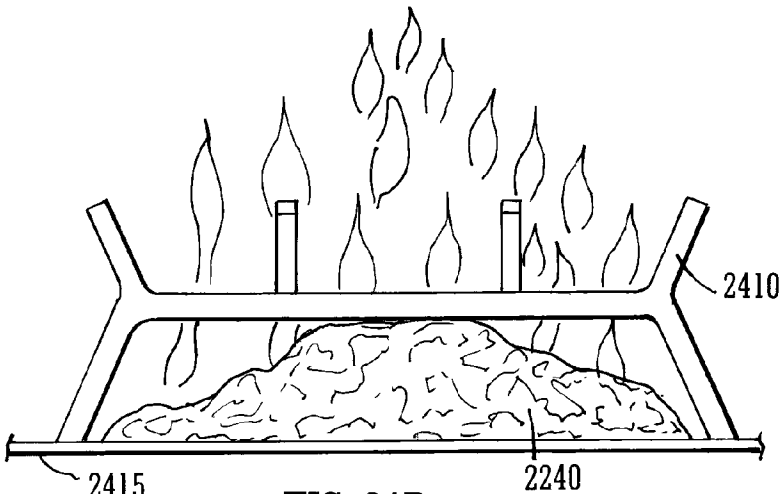

FIGS. 22 and 23 show alternative arrangements that could be implemented within the context of a mist generator for use in the present invention. In both figures a mist reservoir 1910 and and associated chimney or funnel 1920 are utilised subsequent to the generation of the mist to effect a distribution of the mist upwardly—in a manner similar to that described previously. The arrangements of FIGS. 22 and 23 differ from one another and from other arrangements described previously in the manner of formation of the mist generation. In the system of FIG. 23, use of a gravity fed system is taught whereas FIG. 23 relies on a Venturi type system. In FIG. 22 a reservoir 2200 is coupled via a valve 2201, typically a solenoid valve, to a compressor 2203. Water is fed under gravity into the feed line from the compressor where it is then discharged under pressure into the mist buffer 1910. The use of a buffer is particularly advantageous in high pressure implementations such as that shown in FIG. 22, as it ensures that the mist is gathered prior to distribution (and its flow rate is correspondingly reduced) as opposed to being discharged into the fire at high pressures and flow rates where its effects would not be readily as visible.

FIG. 23 is a similar type arrangement implemented using a reservoir 2200 and compressor 2203. This arrangement however works under a Venturi type arrangement similar to that of known for spray nozzles and not under gravity as was employed in the arrangement of FIG. 22.

FIG. 24 shows an example of a fuel bed arrangement 2400 that could be usefully employed in combination with a flame effect fire such as that described hereinbefore. It will be understood however that a fuel bed arrangement such as that described in FIG. 24 could also be employed with other type of simulated fires and should not be limited to application with such 3-Dimensional flame effects which are predominately described herein.

In this arrangement the fuel bed is formed from a fire grate 2410 which provides a base or receiving structure for one or more fire elements (not shown in FIG. 24 but could for example be similar to those elements 400 described previously in relation to FIGS. 4 and 5). The grate 2410 is locatable on a platform or ash tray 2415 and located there between is provided a base moulding 2420 which is configured to be higher in a mid region 2421—coincident with the centre of the fire within which the fuel bed is to be located. By providing a mid region which dominates that of the adjacent side portions of the base moulding it is possible to provide a mount for one or more light sources 2430 which will be higher than other light sources 2435 provided at a level coincident with the ash tray 2415. By differentiating by height the location at which the fuel bed light sources are provided it is possible to provide a dominant lighting for a mid region of the fire—which is analogous to what would be expected in a "real" fire. If the grate is provided over a funnel arrangement and used to illuminate an upwelling mist such as that shown in FIG. 14 (shown in the section view Section B-B of FIG. 24D) then the simulation is particularly effective. Such a fuel bed can be considered as having a first arrangement of light sources and a second arrangement of light sources, the first and second arrangements being vertically offset from one another.

Although specific embodiments have been illustrated and described herein for purposes of description of the preferred embodiment, it will be appreciated by those of ordinary skill in the art that a wide variety of alternate and/or equivalent implementations may be substituted for the specific embodiment shown and described without departing from the scope of the present invention. Those with skill in the art will readily appreciate that the present invention may be implemented in a very wide variety of embodiments. This application is intended to cover any adaptations or variations of the embodiments discussed herein. Therefore, it is manifestly intended that this invention be limited only by the claims and the equivalents thereof.

The words comprises/comprising when used in this specification are to specify the presence of stated features, integers, steps or components but does not preclude the presence or addition of one or more other features, integers, steps, components or groups thereof.

The invention claimed is:

1. A flame effect fire comprising:

a mist generator for generating a mist, a light source co-operable with the mist generator providing a light output directed to the generated mist to effect an illumination of the mist to generate visible flame effects, a separate mist reservoir having an inlet for receiving and gathering the mist generated by the mist generator, the mist reservoir having at least one outlet for distributing the mist, and means for agitating the mist within the mist reservoir so as to promote passage of the mist through the at least one outlet, and, including a fuel bed, the at least one outlet being disposed below the fuel bed.

2. The fire of claim 1, wherein the means for agitating the mist includes means for introducing an air current into the mist reservoir.

3. The fire of claim 2 wherein the means for introducing the air current into the mist reservoir includes a fan provided in a side wall of the mist reservoir and configured to operatively direct air into the reservoir.

4. The fire of claim 3 wherein the at least one outlet extends longitudinally substantially parallel to the front of the fire and the fan is configured to operatively direct air into the fan along the same longitudinal axis.

5. The fire of claim 1 wherein the means for agitating the mist is configured to operatively introduce turbulence effects into the mist reservoir so as to promote movement of the mist within the reservoir towards and out of the at least one outlet.

6. The fire of claim 1 wherein the means for agitating the mist is provided externally of the mist reservoir.

7. The fire of claim 1 wherein the means for agitating the mist includes at least one heating element.

8. The fire of claim 1 wherein the at least one outlet is provided as a slot within the reservoir.

9. The fire of claim 8 wherein the outlet provides for distribution of the mist in a longitudinal fashion about the longitudinal axis of the slot.

10. The fire of claim 8 wherein the outlet slot includes two or more apertures provided along the longitudinal axis of the slot.

11. The fire of claim 1 wherein the at least one outlet provides an opening through which mist may exit upwardly from the mist reservoir.

12. The fire of claim 1 wherein the at least one outlet provides an opening through which the mist may exit sidewardly from the mist reservoir.

13. The fire of claim 1 wherein the at least one outlet extends longitudinally substantially parallel to the front of the fire.

14. The fire of claim 1 wherein a plurality of outlets are provided, the plurality of outlets being arranged coaxially relative to one another.

15. The fire of claim 1 wherein the at least one outlet extends longitudinally in a direction substantially transverse to the axis at which mist exits from the at least one outlet.

16. The fire of claim 1 including a light source offset from the at least one outlet and configured to operatively provide a light output directed onto the side of the exiting mist.

17. The fire of claim 16 wherein the light source includes a plurality of light elements.

18. The fire of claim 17 wherein individual ones of the light sources are independently controllable.

19. The fire of claim 16 wherein the light source is configured to selectively colour portions of the exiting mist.

20. The fire of claim 19 wherein the light source includes a filter providing for selective colouring of different portions of the light from the light source.

21. The fire of claim 20 wherein the selectively colouring provides for a vertical separation of colours projected onto the exiting mist.

22. The fire of claim 19 wherein the light source includes a number of differently coloured light elements.

23. The fire of claim 16 including at least one LED.

24. The fire of claim 16 including at least one low voltage light source.

25. The fire of claim 16 including an at least partially translucent moulding disposed over the light source.

26. The fire of claim 25 wherein the light source includes at least two lighting elements and wherein the at least partially transparent moulding is dimensioned to be higher in a mid portion thereof, the mid portion including a mount for one of the at least two lighting elements, the other of the at least two lighting elements being provided in a lower region of the fire such that two lighting elements are vertically separated from one another.

27. The fire of claim 1 wherein the mist generator includes a first reservoir.

28. The fire of claim 27 wherein the first reservoir is provided in fluid communication with a second reservoir, the second reservoir being removable from the fire.

29. The fire of claim 28 wherein the second removable reservoir is slideably removable through a side portion of the fire.

30. The fire of claim 28 including a locking arrangement, the locking arrangement preventing the accidental removal of the second reservoir from the fire.

31. The fire of claim 30 wherein the locking arrangement and second reservoir engage with one another through a two step locking procedure.

32. The fire of claim 1 wherein the mist generator includes at least one ultrasonic transducer operable to generate the mist.

33. The fire of claim 32 wherein the ultrasonic transducer is configured to be operatively in fluid communication with a fluid provided within a first reservoir.

34. The fire of claim 33 including a second ultrasonic transducer provided in a redundant configuration.

35. The fire of claim 33 including a level indicator operatively providing an indication to a user of the fire of any deviation from the horizontal plane of fluid within the first reservoir.

36. The fire of claim 35 including means for compensating the level of the fire so as to compensate for any deviation from the horizontal plane.

37. The fire of claim 33 including a filter operatively providing a filtering of fluid contained within the first reservoir.

38. The fire of claim 37 wherein the filter is provided instream between the first and second reservoirs.

39. The fire of claim 37 wherein the filter includes an anti-microbial agent.

40. The fire of claim 37 wherein the filter is active against minerals within the fluid.

41. The fire of claim 1 wherein the mist generator includes a compressor.

42. The fire of claim 1 wherein the mist generator and mist reservoir are provided as separate elements.

43. The fire of claim 1 wherein the mist generator and mist reservoir are integrally formed.

44. The fire of claim 1 wherein the at least one outlet provides mist to a distributor, the distributor including a plurality of apertures through which mist may be provided to a fuel bed within the fire.

45. The fire of claim 1 including a controller operative on the mist generator and configured to control the volume of mist generated by the mist generator.

46. A flame effect fire comprising:

a mist generator for generating a mist, a light source co-operable with the mist generator providing a light output directed to the generated mist to effect an illumination of the mist to generate visible flame effects, a separate mist reservoir having an inlet for receiving and gathering the mist generated by the mist generator, the mist reservoir having at least one outlet for distributing the mist, and means for agitating the mist within the mist reservoir so as to promote passage of the mist through the at least one outlet, the mist reservoir including a chimney, the at least one outlet being defined within the chimney, and wherein at least one surface of the chimney is heated.

47. The fire of claim 46 wherein the chimney has a rectangularly shaped cross section.

48. A flame effect fire comprising:

a mist generator for generating a mist, a light source co-operable with the mist generator providing a light output directed to the generated mist to effect an illumination of the mist to generate visible flame effects, a separate mist reservoir having an inlet for receiving and gathering the mist generated by the mist generator, the mist reservoir having at least one outlet for distributing the mist, and means for agitating the mist within the mist reservoir so as to promote passage of the mist through the at least one outlet, wherein the at least one outlet is located proximal to a front portion of the fire and the at least one outlet is provided forwardly of a fuel bed located within a fire.

49. A flame effect fire comprising:

a mist generator for generating a mist, a light source co-operable with the mist generator providing a light output directed to the generated mist to effect an illumination of the mist to generate visible flame effects, a separate mist reservoir having an inlet for receiving and gathering the mist generated by the mist generator, the mist reservoir having at least one outlet for distributing the mist, means for agitating the mist within the mist reservoir so as to promote passage of the mist through the at least one outlet, and a fuel bed, the at least one outlet and fuel bed being arranged relative with one another to enable a flow of mist through the fuel bed.

50. The fire of claim 49 including a planar support member which provides a support for the fuel bed.

51. The fire of claim 50 wherein the planar support member includes an aperture to enable mist exiting from the at least one outlet to pass above the planar support member.

52. The fire of claim 50 wherein the at least one outlet is coincident with the surface of the planar support member.

53. The fire of claim 50 wherein the planar support member includes at least one aperture to allow light from a light source located below the planar support member to be directed upwardly.

54. The fire of claim 53 wherein the light is operatively directed onto a side portion of mist exiting from the at least one outlet.

55. The fire of claim 53 wherein the light is operatively directed into the mist exiting.

56. A flame effect fire comprising:

a mist generator for generating a mist, a light source co-operable with the mist generator providing a light output directed to the generated mist to effect an illumination of the mist to generate visible flame effects, a separate mist reservoir having an inlet for receiving and gathering the mist generated by the mist generator, the mist reservoir having at least one outlet for distributing the mist, and means for agitating the mist within the mist reservoir so as to promote passage of the mist through the at least one outlet, the mist reservoir including a chimney, the at least one outlet being defined within the chimney, and the chimney having a rectangularly shaped cross section, wherein the first and second sides of the rectangle defining the length of the rectangle are heatable, and a first side is preferentially heated relative to a second side.

57. A flame effect fire comprising:

a mist generator for generating a mist, a light source co-operable with the mist generator providing a light output directed to the generated mist to effect an illumination of the mist to generate visible flame effects, a separate mist reservoir having an inlet for receiving and gathering the mist generated by the mist generator, the mist reservoir having at least one outlet for distributing the mist, and means for agitating the mist within the mist reservoir so as to promote passage of the mist through the at least one outlet, the mist reservoir including a chimney, the at least one outlet being defined within the chimney, and the chimney having a rectangularly shaped cross section, wherein the first and second sides of the rectangle defining the length of the rectangle are heatable, wherein the fire includes a light source provided to direct light into mist exiting the at least one outlet and the first side is provided proximal to said light source.

58. A flame effect fire comprising:

a mist generator for generating a mist, a light source co-operable with the mist generator providing a light output directed to the generated mist to effect an illumination of the mist to generate visible flame effects, a separate mist reservoir having an inlet for receiving and gathering the mist generated by the mist generator, the mist reservoir having at least one outlet for distributing the mist, and means for agitating the mist within the mist reservoir so as to promote passage of the mist through the at least one outlet, wherein the mist generator and mist reservoir are locatable within a lower region of the fire, the fire including a fuel bed locatable above the mist generator and mist reservoir.

59. The fire of claim 58 wherein the at least one outlet is positioned relative to the fuel bed to operatively provide a mist through the fuel bed.

60. The fire of claim 59 wherein elements of the fuel bed are locatable on either side of the at least one outlet.

61. The fire of claim 58 wherein the fuel bed includes an ashtray, a fire grate and fuel elements.

62. The fire of claim 61 wherein each of the fuel elements and ash tray include independently operable lighting elements.

63. The fire of claim 61 wherein individual ones of the fuel elements include a plurality of lighting elements, selected one of the plurality being independently controllable with respect to others of the plurality.

64. The fire of claim 63 including a controller coupled to the plurality of lighting elements and configured to operatively provide a control signal to effect selective illumination of individual ones of the plurality of lighting elements.

65. The fire of claim 58 wherein the fire includes side walls located about the fuel bed.

66. The fire of claim 65 wherein at least two of the side walls are at least partially transparent.

67. The fire of claim 65 wherein one of the side walls includes a brick effect pattern.

68. The fire of claim 65 including an air heater disposed in an upper region of the fire and configured to direct heat downwardly over an outer surface of at least one of the side walls.

69. The fire of claim 58 wherein the fire includes a heating element provided above the fuel bed and being configured to operatively provide heat circumferentially about a perimeter of the fire.

70. The fire of claim 69 including a chimney located above the side walls, the chimney including a vent through which air may escape out of the fire.

71. The fire of claim 70 wherein the heating element is located at least proximal to the chimney.

72. The fire of claim 71 wherein the heating element is a radiant heating element provided within the region defined by the chimney.

73. The fire of claim 70 wherein the heating element disposed at least proximal to the chimney is configured to operatively provide a heating of the air prior to its escape from the vent.

74. A flame effect fire comprising:

a mist generator for generating a mist, a light source co-operable with the mist generator providing a light output directed to the generated mist to effect an illumination of the mist to generate visible flame effects, a separate mist reservoir having an inlet for receiving and gathering the mist generated by the mist generator, the mist reservoir having at least one outlet for distributing the mist, and means for agitating the mist within the mist reservoir so as to promote passage of the mist through the at least one outlet, wherein the fuel bed includes an ashtray, a fire grate and fuel elements, wherein individual ones of the fuel elements include a plurality of lighting elements, selected one of the plurality of lighting elements being independently controllable with respect to others of the plurality of lighting elements, and including a controller coupled to the plurality of lighting elements and configured to operatively provide a control signal to effect selective illumination of individual ones of the plurality of lighting elements, wherein the mist reservoir is located downstream of the mist generator.

75. The fire of claim 74 wherein the mist generator includes a source of compressed air and the passage of the mist from the generator into the reservoir provides the means for agitating the mist within the reservoir.

76. A flame effect fire comprising:

a mist generator for generating a mist and a light source co-operable with the mist generator providing a light output directed to the generated mist to effect an illumination of the mist to generate visible flame effects, a separate mist reservoir having an inlet for receiving and gathering the mist generated by the mist generator, the mist reservoir having at least one outlet for distributing the mist, and means for agitating the mist within the mist reservoir so as to promote passage of the mist through the at least one outlet, wherein the means for agitating the mist includes at least one heating element.

* * * * *

UNITED STATES PATENT AND TRADEMARK OFFICE

CERTIFICATE OF CORRECTION

PATENT NO. : 8,413,358 B2
APPLICATION NO. : 12/677918
DATED : April 9, 2013
INVENTOR(S) : Betz et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 268 days.

Signed and Sealed this
Fourth Day of June, 2013

Teresa Stanek Rea
*Acting Director of the United States Patent and Trademark Office*